US006425964B1

(12) United States Patent
Deevi et al.

(10) Patent No.: US 6,425,964 B1
(45) **Date of Patent: *Jul. 30, 2002**

(54) CREEP RESISTANT TITANIUM ALUMINIDE ALLOYS

(75) Inventors: Seetharama C. Deevi, Midlothian; Wei-Jun Zhang, Richmond, both of VA (US)

(73) Assignee: Chrysalis Technologies Incorporated, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/660,961

(22) Filed: Sep. 13, 2000

Related U.S. Application Data

(63) Continuation-in-part of application No. 09/174,103, filed on Oct. 16, 1998, now Pat. No. 6,214,133, which is a continuation of application No. 09/017,483, filed on Feb. 2, 1998, now abandoned.

(51) Int. Cl.[7] ..... C22C 14/00
(52) U.S. Cl. ..... 148/421; 420/418
(58) Field of Search ..... 148/421; 420/418

(56) References Cited

U.S. PATENT DOCUMENTS

| | | | |
|---|---|---|---|
| 4,842,819 | A | 6/1989 | Huang et al. |
| 4,917,858 | A | 4/1990 | Eylon et al. |
| 5,196,162 | A | 3/1993 | Maki et al. |
| 5,232,661 | A | 8/1993 | Matsuo et al. |
| 5,342,577 | A | 8/1994 | Nazmy et al. |
| 5,348,702 | A | 9/1994 | Matsuo et al. |
| 5,350,466 | A | 9/1994 | Larsen, Jr. et al. |
| 5,370,839 | A | 12/1994 | Masahashi et al. |
| 5,417,781 | A | 5/1995 | McQuay et al. |
| 5,429,796 | A | 7/1995 | Larsen, Jr. |
| 5,489,411 | A | 2/1996 | Jha et al. |
| 5,503,794 | A | 4/1996 | Ritter et al. |
| 5,530,225 | A | 6/1996 | Hajaligol |
| 5,591,368 | A | 1/1997 | Fleischhauer et al. |
| 5,634,992 | A | 6/1997 | Kelly et al. |
| 5,746,846 | A | 5/1998 | Kim et al. |
| 6,214,133 | B1 | 4/2001 | Deevi et al. |

FOREIGN PATENT DOCUMENTS

| | | |
|---|---|---|
| EP | 365174 | 4/1990 |
| JP | 63-171862 | 7/1988 |
| JP | 64-42539 | 2/1989 |
| JP | 1-259139 | 10/1989 |

OTHER PUBLICATIONS

V.R. Ryabov et al. entitled "Properties of the Intermetallic Compounds of the System Iron–Aluminum", Metal Metalloved, 27, No. 4, 668–673, 1969.

S.M. Barinov et al. entitled "Deformation and Failure in Titanium Aluminide", Izvestiya Akademii Nauk SSSR Metally, No. 3, 164–168, 1984.

W. Wunderlich et al. entitled "Enhanced Plasticity by Deformation Twinning of Ti–Al–Base Alloys with Cr and Si", Z. Metallkunde, 802–808, Nov. 1990.

T. Tsujimoto entitled "Research, Development, and Prospects of TiA1 Intermetallic Compound Alloys", Titanium and Zirconium, vol. 33, No. 3, 19 pages, Jul. 1985.

(List continued on next page.)

*Primary Examiner*—John Sheehan
(74) *Attorney, Agent, or Firm*—Burns, Doane, Swecker & Mathis, LLP

(57) ABSTRACT

A creep resistant titanium aluminide alloy having fine particles such as boride particles at colony boundaries and/or grain boundary equiaxed structures. The alloy can include alloying additions such as ≦10 at % W, Nb and/or Mo. The alloy can be free of Cr, V, Mn, Cu and/or Ni and can include, in atomic %, 45 to 55% Ti, 40 to 50% Al, 1 to 10% Nb, 0.1 to 2% W, up to 1% Mo and 0.1 to 0.8% B or the alloy can include, in weight %, 50 to 65% Ti, 25 to 35% Al, 2 to 20% Nb, up to 5% Mo, 0.5 to 10% W and 0.01 to 0.5% B.

25 Claims, 21 Drawing Sheets

U.S. PATENT DOCUMENTS

N. Maeda entitled "High Temperature Plasticity of Intermetallic Compound TiA1" presented at Material of 53rd Meeting of Superplasticity, 13 pages, Jan. 30, 1990.

N. Maeda et al. entitled "Improvement in Ductility of Intermetallic Compound through Grain Super–refinement" presented at Autumn Symposium of the Japan Institute of Metals, 14 pages, 1989.

S. Noda et al. entitled "Mechanical Properties of TiA1 Intermetallic Compound" presented at Autumn Symposium of the Japan Institute of Metals, 3 pages, 1988.

H.A. Lipsitt entitled "Titanium Aluminides—An Overview", Mat. Res. Soc. Symp. Proc. vol. 39, 351–364, 1985.

P.L. Martin et al. entitled "The Effects of Alloying on the Microstructure and Properties of $Ti_3$ A1 and TiA1", ASM in Titanium 80, vol. 2, 1245–1254, 1980.

S.H. Whang et al. entitled "Effect of Rapid Solidification in $L1_0$ TiA1 Compound Alloys" ASM Symposium Proceedings on Enhanced Properties in Structural Metals Via Rapid Solidification, Materials Week, 7 pages, 1986.

D. Vujic et al. entitled "Effect of Rapid Solidification and Alloying Addition on Lattice Distortion and Atomic Ordering in $L1_0$ TiA1 Alloys and Their Ternary Alloys", Metallurgical Transactions A, vol. 19A, 2445–2455, Oct. 1988.

CREEP RESISTANT TITANIUM ALUMINIDE ALLOYS

This application is a Continuation-In-Part of application Ser. No. 09/174,103, filed Oct. 16, 1998 now U.S. Pat. No. 6,214,133, which is a continuation of application Ser. No. 09/017,483, filed Feb. 2, 1998, now abandoned, the entire content of which is hereby incorporated by reference.

FIELD OF THE INVENTION

The invention relates generally to creep resistant titanium aluminide alloy compositions useful for resistive heating and other applications such as structural applications.

BACKGROUND OF THE INVENTION

Titanium aluminide alloys are the subject of numerous patents and publications including U.S. Pat. Nos. 4,842,819; 4,917,858; 5,232,661; 5,348,702; 5,350,466; 5,370,839; 5,429,796; 5,503,794; 5,634,992; and 5,746,846, Japanese Patent Publication Nos. 63-171862; 1-259139; and 1-42539; European Patent Publication No. 365174 and articles by V. R. Ryabov et al entitled "Properties of the Intermetallic Compounds of the System Iron-Aluminum" published in Metal Metalloved, 27, No.4, 668–673, 1969; S. M. Barinov et al entitled "Deformation and Failure in Titanium Aluminide" published in Izvestiya Akademii Nauk SSSR Metally, No. 3, 164–168, 1984; W. Wunderlich et al entitled "Enhanced Plasticity by Deformation Twinning of Ti—Al-Base Alloys with Cr and Si" published in Z. Metallkunde, 802–808, November 1990; T. Tsujimoto entitled "Research, Development, and Prospects of TiAl Intermetallic Compound Alloys" published in Titanium and Zirconium, Vol. 33, No. 3, 19 pages, July 1985; N. Maeda entitled "High Temperature Plasticity of Intermetallic Compound TiAl" presented at Material of 53$^{rd}$ Meeting of Superplasticity, 13 pages, Jan. 30, 1990; N. Maeda et al entitled "Improvement in Ductility of Intermetallic Compound through Grain Super-refinement" presented at Autumn Symposium of the Japan Institute of Metals, 14 pages, 1989; S. Noda et al entiitled "Mechanical Properties of TiAl Intermetallic Compound" presented at Autumn Symposium of the Japan Institute of Metals, 3 pages, 1988; H. A. Lipsitt entitled "Titanium Aluminides—An Overview" published in Mat. Res. Soc. Symp. Proc. Vol. 39, 351–364, 1985; P. L. Martin et al entitled "The Effects of Alloying on the Microstructure and Properties of $Ti_3Al$ and TiAl" published by ASM in Titanium 80, Vol. 2, 1245–1254, 1980; S. H. Whang et al entitled "Effect of Rapid Solidification in $L1_0$ TiAl Compound Alloys" ASM Symposium Proceedings on Enhanced Properties in Structural Metals Via Rapid Solidification, Materials Week, 7 pages, 1986; and D. Vujic et al entitled "Effect of Rapid Solidification and Alloying Addition on Lattice Distortion and Atomic Ordering in $L1_0$ TiAl Alloys and Their Ternary Alloys" published in Metallurgical Transactions A, Vol. 19A, 2445–2455, October 1988.

Methods by which TiAl aluminides can be processed to achieve desirable properties are disclosed in numerous patents and publications such as those mentioned above. In addition, U.S. Pat. No. 5,489,411 discloses a powder metallurgical technique for preparing titanium aluminide foil by plasma spraying a coilable strip, heat treating the strip to relieve residual stresses, placing the rough sides of two such strips together and squeezing the strips together between pressure bonding rolls, followed by solution annealing, cold rolling and intermediate anneals. U.S. Pat. No. 4,917,858 discloses a powder metallurgical technique for making titanium aluminide foil using elemental titanium, aluminum and other alloying elements. U.S. Pat. No. 5,634,992 discloses a method of processing a gamma titanium aluminide by consolidating a casting and heat treating the consolidated casting above the eutectoid to form gamma grains plus lamellar colonies of alpha and gamma phase, heat treating below the eutectoid to grow gamma grains within the colony structure and heat treating below the alpha transus to reform any remaining colony structure to a structure having $\alpha_2$ laths within gamma grains.

Still, in view of the extensive efforts to improve properties of titanium aluminides, there is a need for improved alloy compositions and economical processing routes.

SUMMARY OF THE INVENTION

According to a first embodiment, the invention provides a two-phase titanium aluminum alloy having a lamellar microstructure controlled by colony size. The alloy can be provided in various forms such as in the as-cast, hot extruded, cold and hot worked, or heat treated condition. As an end product, the alloy can be fabricated into an electrical resistance heating element having a resistivity of 60 to 200 $\mu$106 ·cm. The alloy can include additional elements which provide fine particles such as second-phase or boride particles at colony boundaries. The alloy can include grain-boundary equiaxed structures. The additional alloying elements can include, for example, up to 10 at % W, Nb and/or Mo. The alloy can be processed into a thin sheet having a yield strength of more than 80 ksi (560 MPa), an ultimate tensile strength of more than 90 ksi (630 MPa), and/or tensile elongation of at least 1.5%. The aluminum can be present in an amount of 40 to 50 at %, preferably about 46 at %. The titanium can be present in the amount of at least 45 at %, preferably at least 50 at %. As an example, the alloy can include 45 to 55 at % Ti, 40 to 50 at % Al, 1 to 5 at % Nb, 0.5 to 2 at % W, and 0.1 to 0.3 at % B. The alloy is preferably free of Cr, V, Mn and/or Ni.

According to a second embodiment, the invention provides a creep resistant titanium aluminum alloy consisting essentially of, in weight %, 50 to 65 % Ti, 25 to 35 % Al, 2 to 20% Nb, 0.5 to 10% W, and 0.01 to 0.5% B. The titanium aluminide alloy can be provided in an as-cast, hot extruded, cold worked, or heat treated condition. The alloy can have a two-phase lamellar microstructure with fine particles that are located at colony boundaries, e.g., fine boride particles located at the colony boundaries and/or fine second-phase particles located at the colony boundaries. The alloy can also have a two-phase microstructure including grain-boundary equiaxed structures and/or W is distributed non-uniformly in the microstructure. The alloy can have various compositions including: (1) 45 to 48 atomic % Al, 3 to 10 atomic % Nb, 0.1 to 0.9 atomic % W and 0.02 to 0.8 atomic % B; (2) 46 to 48 atomic % Al, 7 to 9 atomic % Nb, 0.1 to 0.6 atomic % W, and 0.04 to 0.6 atomic % B; (3) 1 to 9 at % Nb, ≦1 at % Mo and 0.2 to 2 at % W; (4) 45 to 55 at % Ti, 40 to 50 at % Al, 1 to 10 at % Nb, 0.1 to 1.5 at % W, and 0.05 to 0.5 at % B; (5) TiAl with 6 to 10 at % Nb, 0.2 to 0.5 at % W, and 0.05 to 0.5 at % B; (6) a titanium aluminide alloy free of Co, Cr, Cu, Mn, Mo, Ni and/or V. The alloy can be processed into a shape such as a thin sheet having a thickness of 8 to 30 mils and a yield strength of more than 80 ksi (560 MPa), an ultimate tensile strength of more than 90 ksi (680 MPa) and/or tensile elongation of at least 1%. Preferably, the alloy exhibits a creep rate of less than about $5\times10^{-10}$/sec under a stress of 100 MPa, less than about $10^{-9}$/sec under a stress of 150 MPa, and/or less than about $10^{-8}$/sec under a stress of 200 MPa or the alloy exhibits a creep strain of at least 1000 hours under a stress of 140 MPa and temperature of 760° C.

BRIEF DESCRIPTION OF THE DRAWINGS

FIG. 1*a* shows the microstructure of PMTA-1, FIG. 1*b* shows the microstructure of PMTA-2, FIG. 1*c* shows the microstructure of PMTA-3 and FIG. 1*d* shows the microstructure of PMTA-4;

FIG. 2*a* shows the microstructure of PMTA-1, FIG. 2*b* shows the microstructure of PMAT-2, FIG. 2*c* shows the microstructure of PMAT-3 and FIG. 2*d* shows the microstructure of PMTA-4;

DETAILED DESCRIPTION OF THE PREFERRED EMBODIMENTS

Figure 1A:
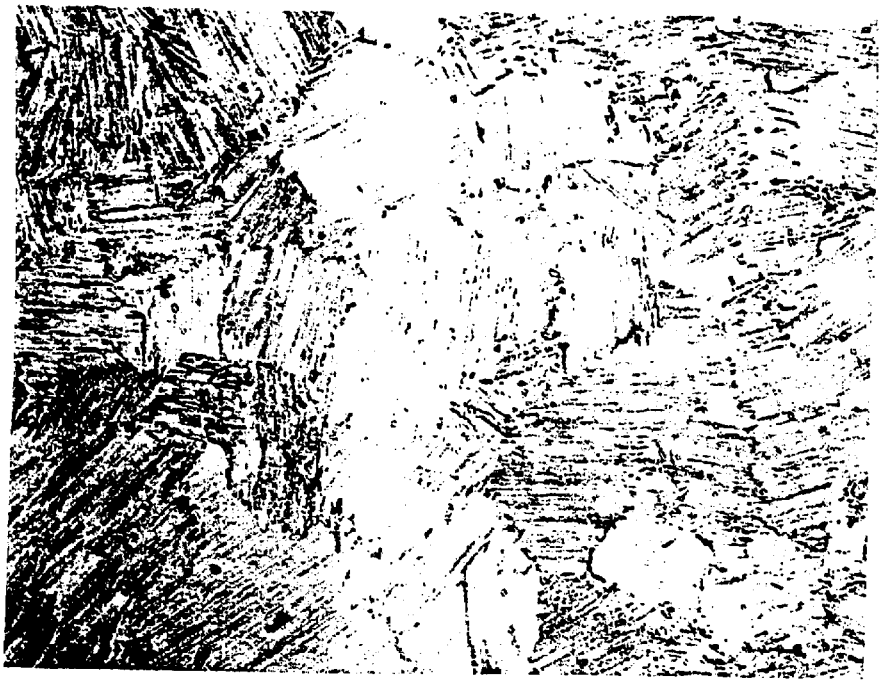
FIGS. 1*a–d* are optical micrographs at 200× of PMTA TiAl alloys hot extruded at 1400° C. and annealed for 2 hours at 1000° C.
Figure 1B:
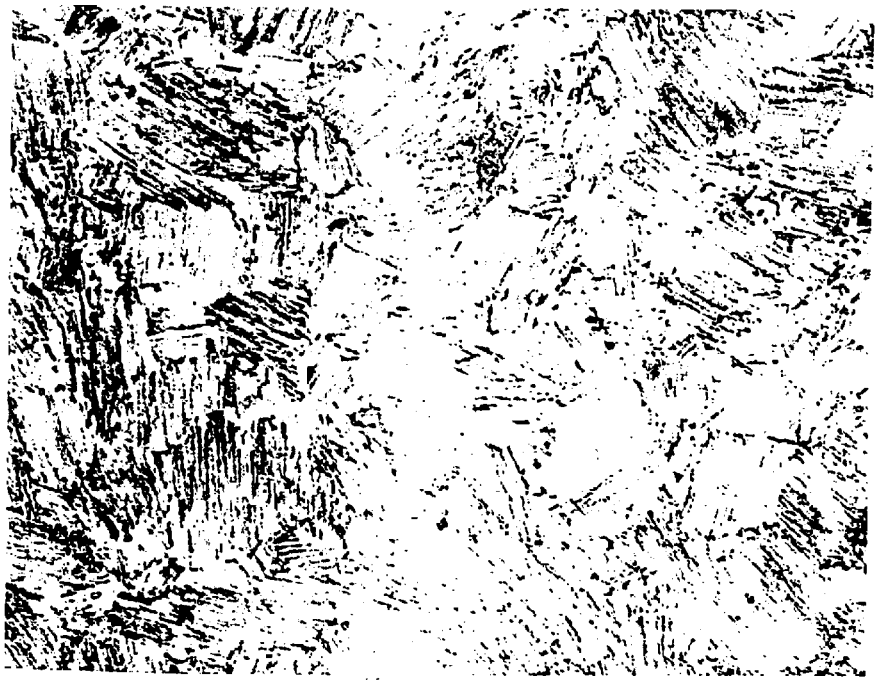
Figure 1C:
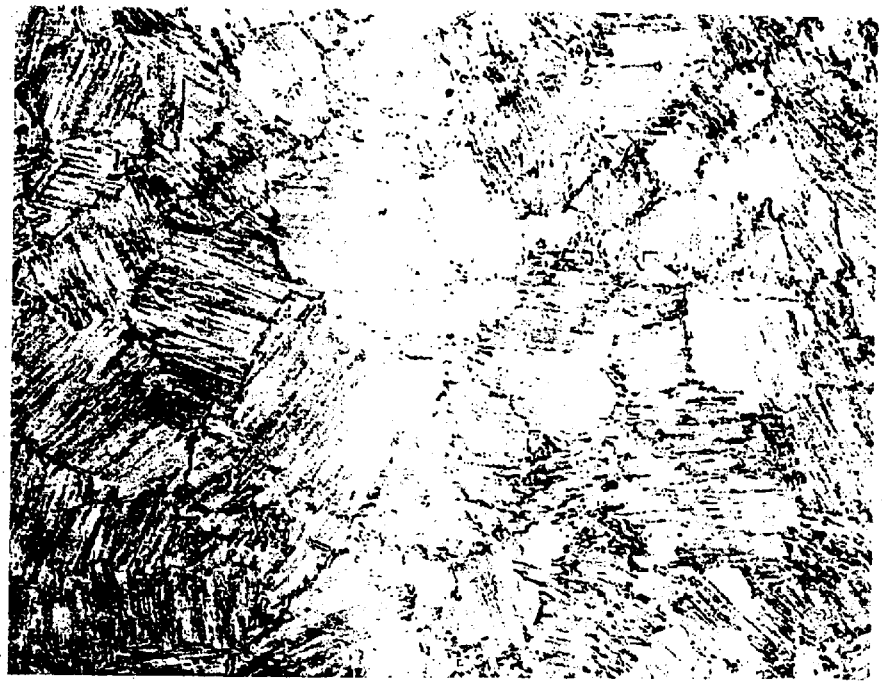
Figure 1D:
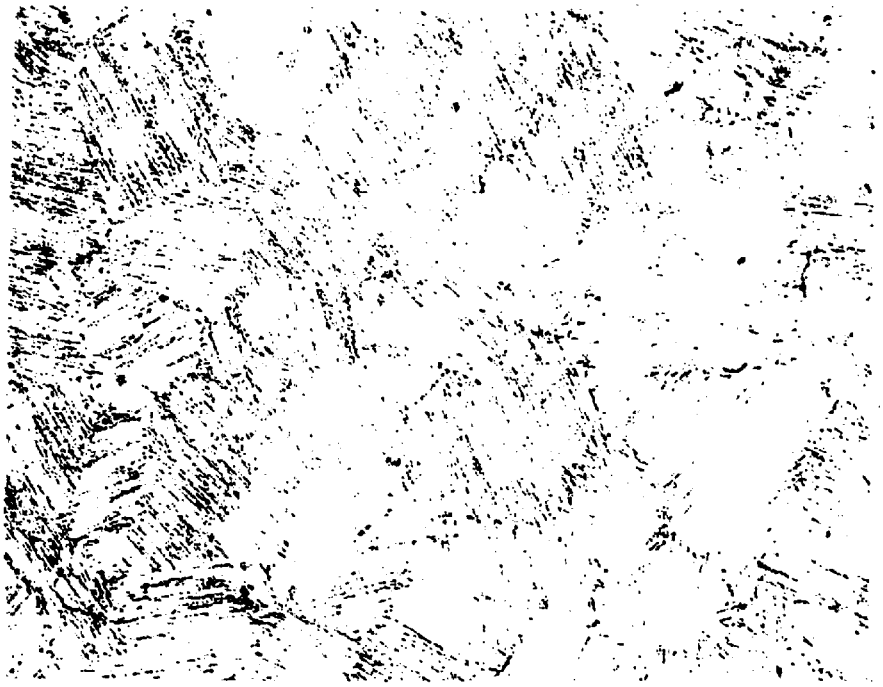
Figure 2A:
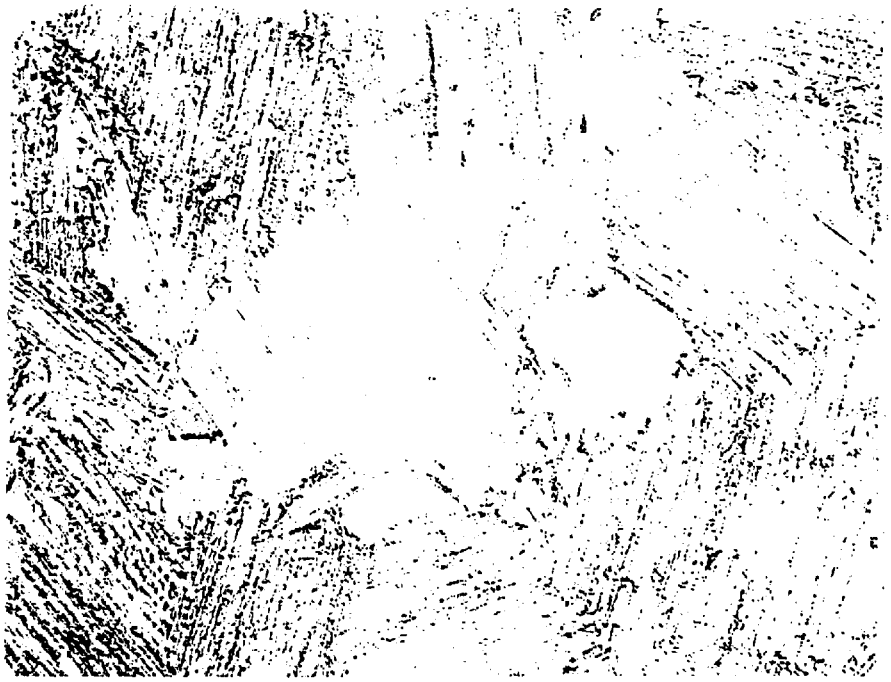
FIGS. 2*a–d* show optical micrographs at 500× of PMTA alloys hot extruded at 1400° C. and annealed for 2 hours at 1000° C.
Figure 2B:
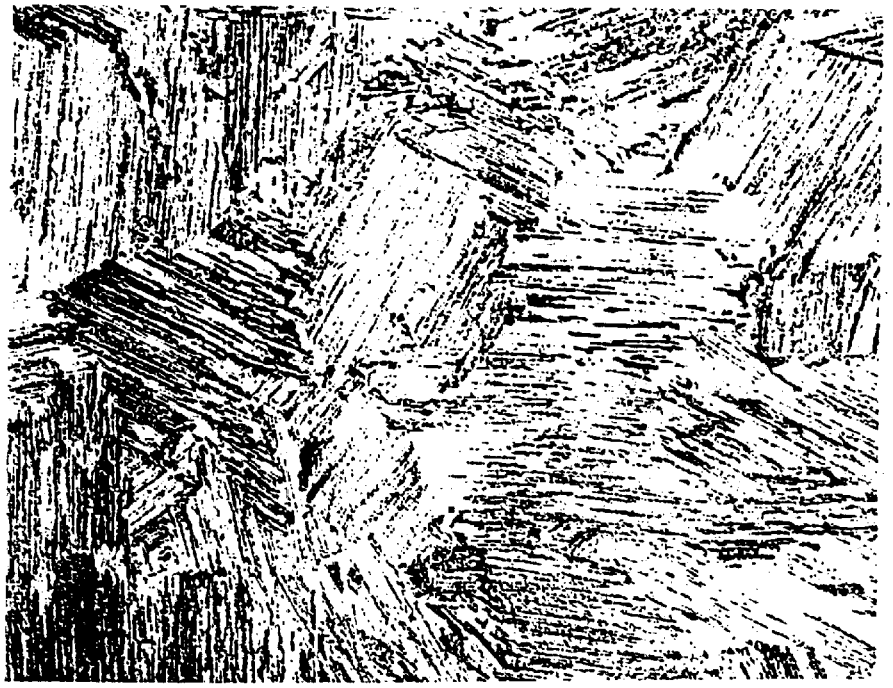
Figure 2C:
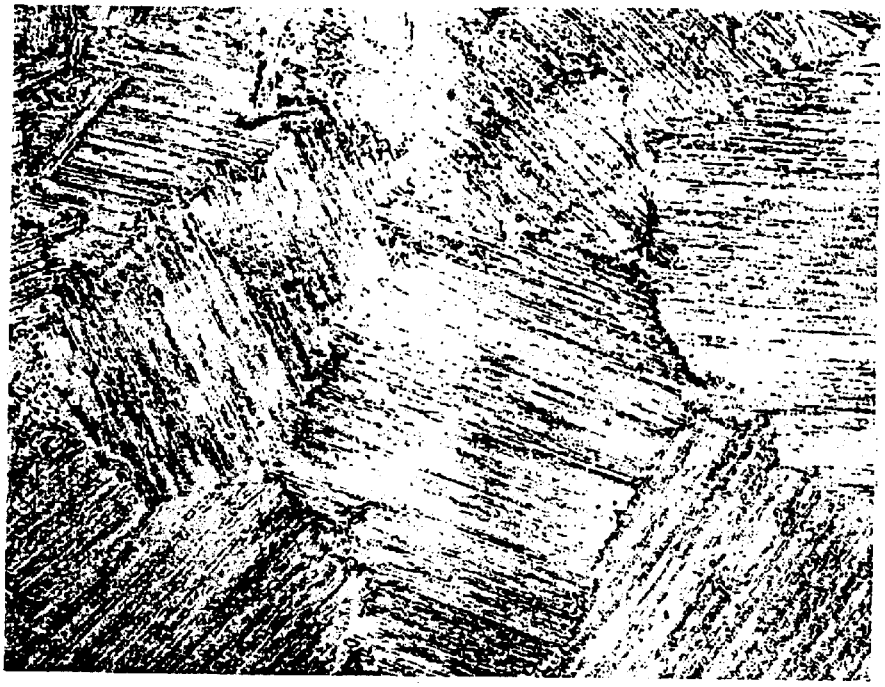
Figure 2D:
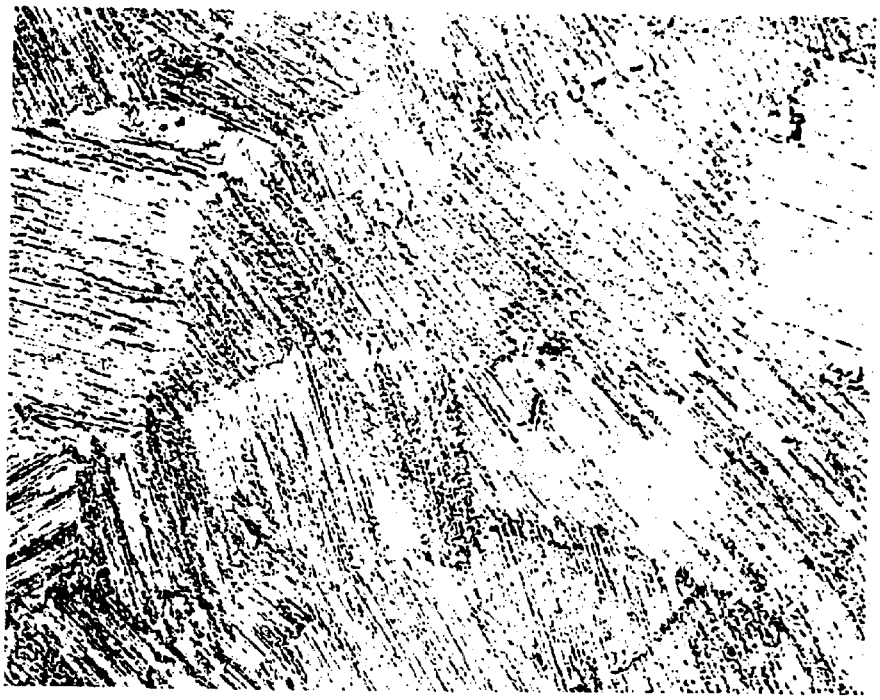

The invention provides two-phase TiAl alloys with thermo-physical and mechanical properties useful for various applications such as resistance heater elements. The alloys exhibit useful mechanical properties and corrosion resistance at elevated temperatures up to 1000° C. and above. The TiAl alloys have extremely low material density (about 4.0 g/cm$^3$), a desirable combination of tensile ductility and strength at room and elevated temperatures, high electrical resistance, and/or can be fabricated into sheet material with thickness <10 mil. One use of such sheet material is for resistive heating elements of devices such as cigarette lighters. For instance, the sheet can be formed into a tubular heating element having a series of heating strips which are individually powered for lighting portions of a cigarette in an electrical smoking device of the type disclosed in U.S. Pat. Nos. 5,591,368 and 5,530,225, the disclosures of which are hereby incorporated by reference. In addition, the alloys can be free of elements such as Cr, V, Mn and/or Ni.

Compared to TiAl alloys containing 1 to 4 at % Cr, V, and/or Mn for improving tensile ductility at ambient temperatures, according to the present invention, tensile ductility of dual-phase TiAl alloys with lamellar structures can be mainly controlled by colony size, rather than such alloying elements. The invention thus provides high strength TiAl alloys which can be free of Cr, V, Mn and/or Ni.

Table 1 lists nominal compositions of alloys investigated wherein the base alloy contains 46.5 at % Al, balance Ti. Small amounts of alloying additions were added for investigating effects on mechanical and metallurgical properties of the two-phase TiAl alloys. Nb in amounts up to 4% was examined for possible effects on oxidation resistance, W in amounts of up to 1.0% was examined for effects on microstructural stability and creep resistance, and Mo in amounts of up to 0.5% was examined for effects on hot fabrication. Boron in amounts up to 0.18% was added for refinement of lamellar structures in the dual-phase TiAl alloys.

Eight alloys identified as PMTA-1 to 9, having the compositions listed in Table 1, were prepared by arc melting and drop casting into a 1" diameter×5" long copper mold, using commercially-pure metals. All the alloys were successfully cast without casting defects. Seven alloy ingots (PMTA-1 to 4 and 6 to 9) were then canned in Mo cans and hot extruded at 1335 to 1400° C. with an extrusion ratio of 5:1 to 6:1. The extrusion conditions are listed in Table 2. The cooling rate after extrusion was controlled by air cooling and quenching the extruded rods in water for a short time. The alloy rods extruded at 1365 to 1400° C. showed an irregular shape whereas PMTA-8 hot-extruded at 1335° C. exhibited much smoother surfaces without surface irregularities. However, no cracks were observed in any of the hot-extruded alloy rods.

The microstructures of the alloys were examined in the as-cast and heat treated conditions (listed in Table 2) by optical metallography and electron superprobe analyses. In the as-cast condition, all the alloys showed lamellar structure with some degree of segregation and coring. FIGS. 1 and 2 show the optical micrographs, with a magnification of 200× and 500×, respectively, for hot extruded alloys PMTA-1 to 4 stress-relieved for 2 hours at 1000° C. All the alloys showed fully lamellar structures, with a small amount of equiaxed grain structures at colony boundaries. Some fine particles were observed at colony boundaries, which are identified as borides by electron microprobe analyses. Also, there is no apparent difference in microstructural features among these four PMTA alloys.

Figure 3:
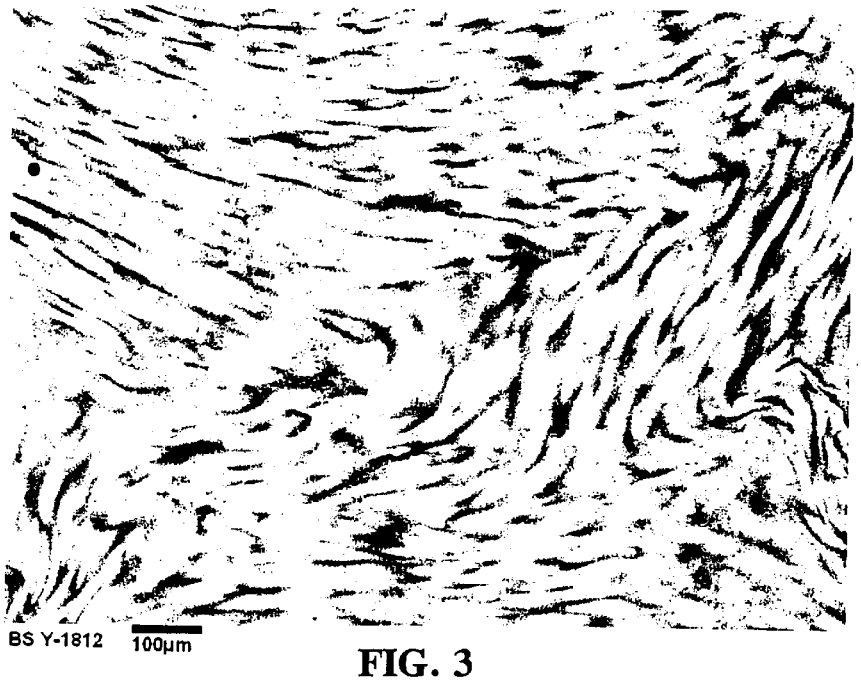
FIG. 3 shows ghost-pattern bands observed in a back-scattered image of PMTA-2 hot extruded at 1400° C. and annealed for 2 hours at 1000° C. wherein the non-uniform distribution of W is shown.
Figure 4:
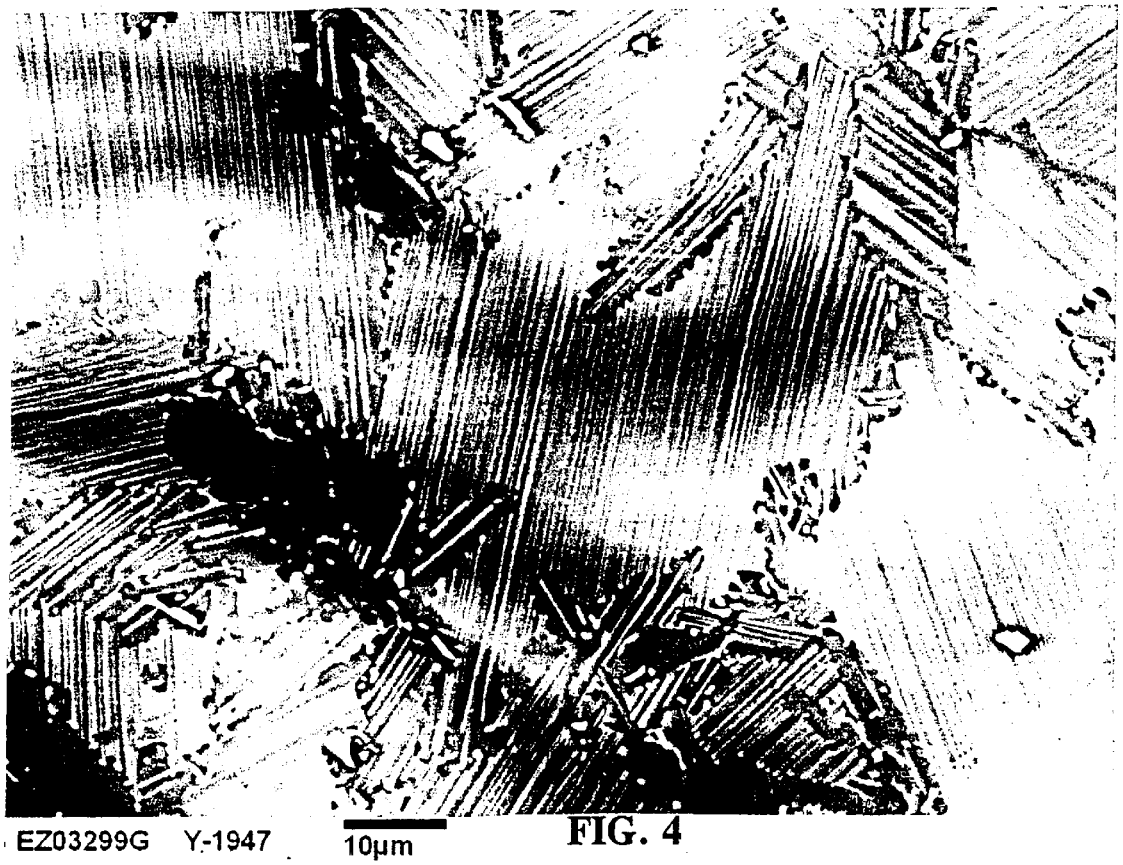
FIG. 4 shows a back-scattered image of PMTA-2 hot extruded at 1400° C. and annealed for 2 hours at 1000° C.

Electron microprobe analyses reveal that tungsten is not uniformly distributed even in the hot extruded alloys. As shown in FIG. 3, the ghost-pattern bands in a darker contrast are found to be depleted with about 0.33 at % W. FIG. 4 is a back-scattered image of PMTA-2, showing the formation of second-phase particles (borides) in a bright contrast at colony boundaries. The composition of the borides was determined and listed in Table 3 together with that of the lamellar matrix. The second-phase particles are essentially (Ti, W, Nb) borides, which are decorated and pinned lamellar colony boundaries.

Figure 5A:
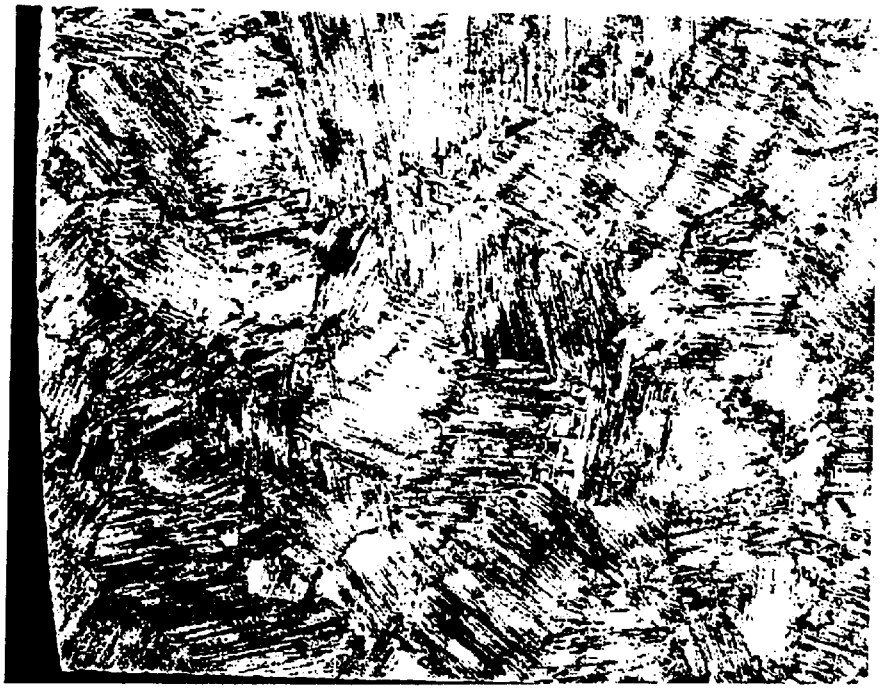
FIG. 5*a* is a micrograph at 200× of PMTA-3 hot extruded at 1400° C. and annealed for one day at 1000° C.
Figure 5B:
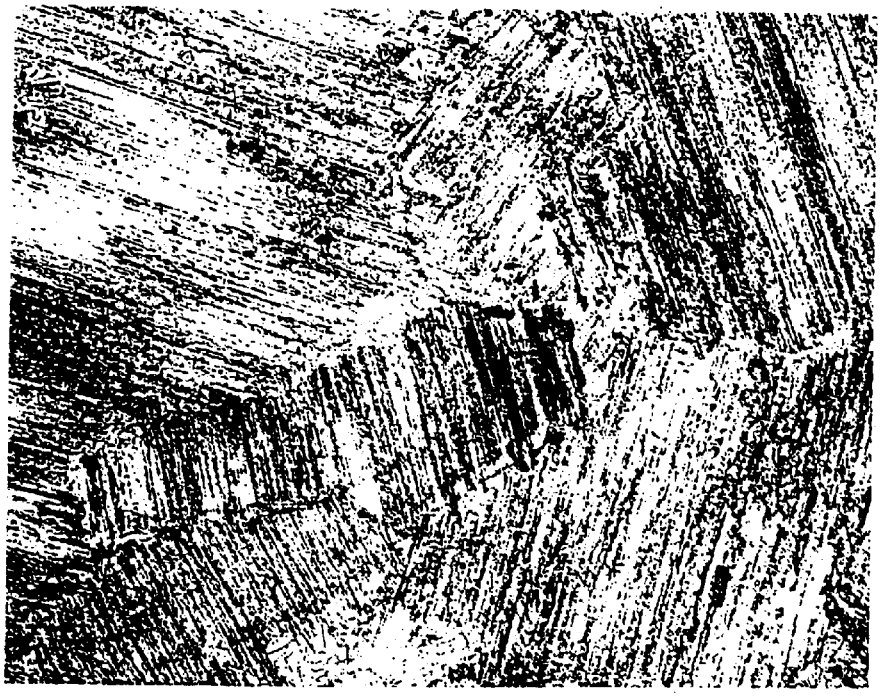
FIG. 5*b* shows the same microstructure at 500×.
Figure 6A:
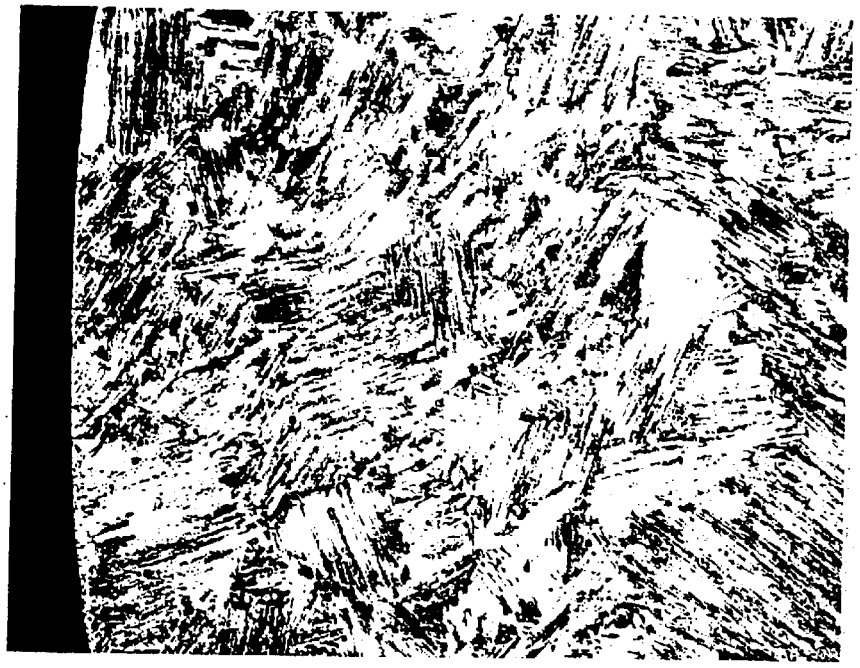
FIG. 6*a* shows the microstructure at 200× of PMTA-2 hot extruded at 1400° C. and annealed for 3 days at 1000° C.
Figure 6B:
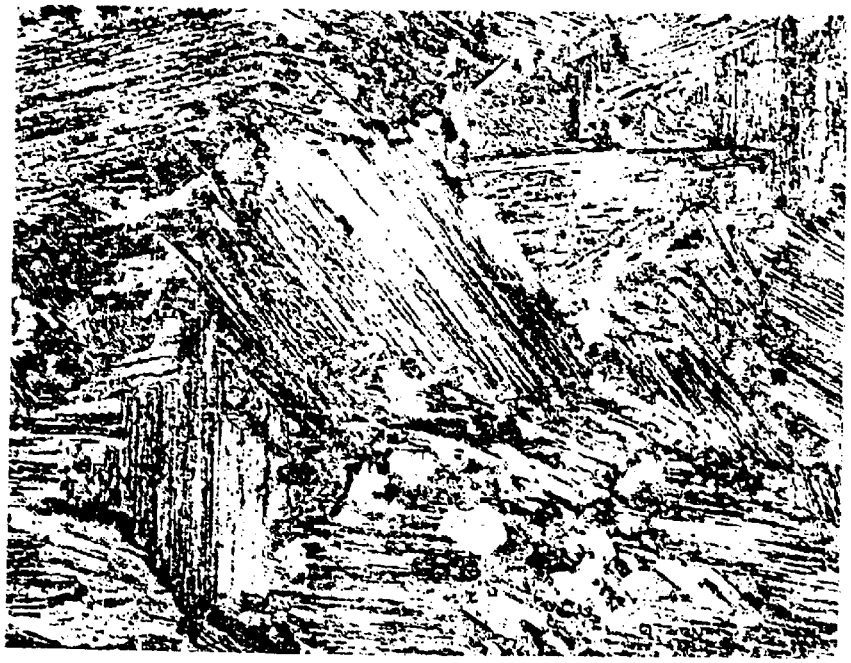
FIG. 6*b* shows the same microstructure at 500×.

FIGS. 5 and 6 show the optical microstructures of hot extruded PMTA-3 and 2 annealed for 1 day and 3 days at 1000° C., respectively. Grain-boundary equiaxed structures are clearly observed in these long-term annealed specimens, and the amount increases with the annealing time at 1000° C. A significant amount of equiaxed grain structures exists in the specimen annealed for 3 days at 1000° C.

Figure 7A:
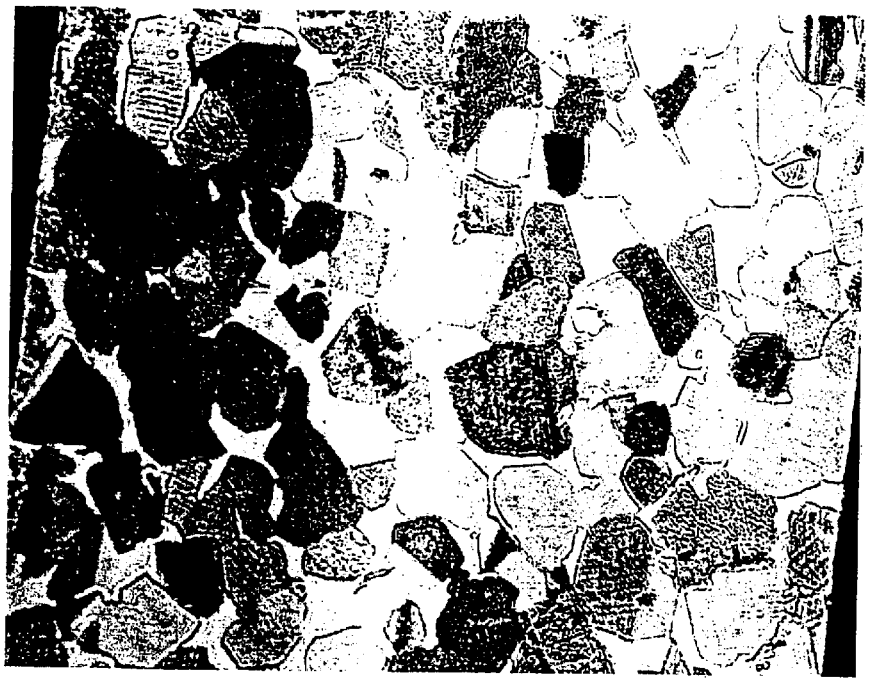
FIG. 7*a* is an optical micrograph of TiAl sheet (Ti-45Al-5Cr, at %) in the as-received condition
Figure 7B:
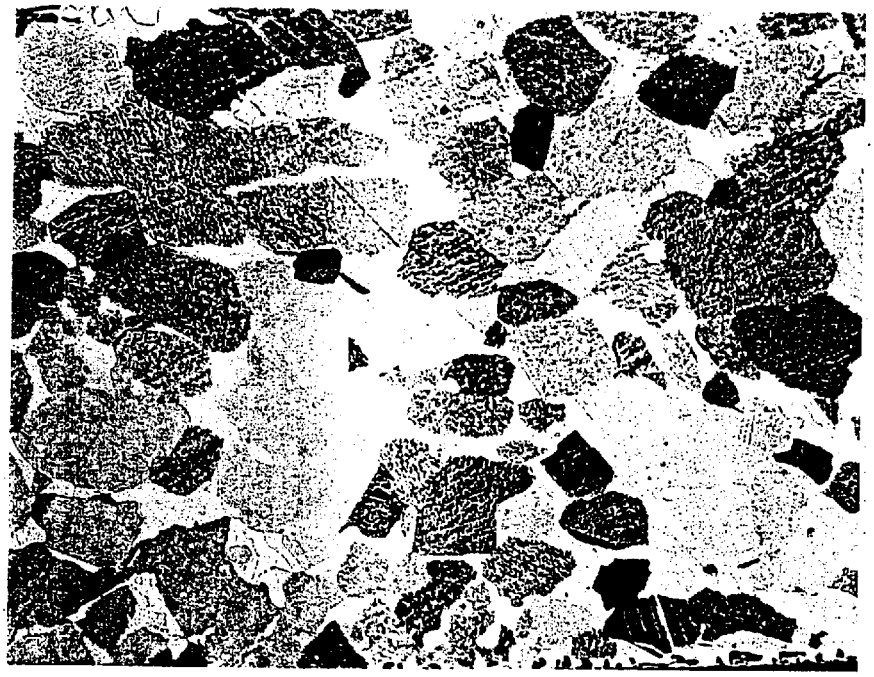
FIG. 7*b* shows the same microstructure after annealing for 3 days at 1000° C., both micrographs at 500×.
Figure 8A:
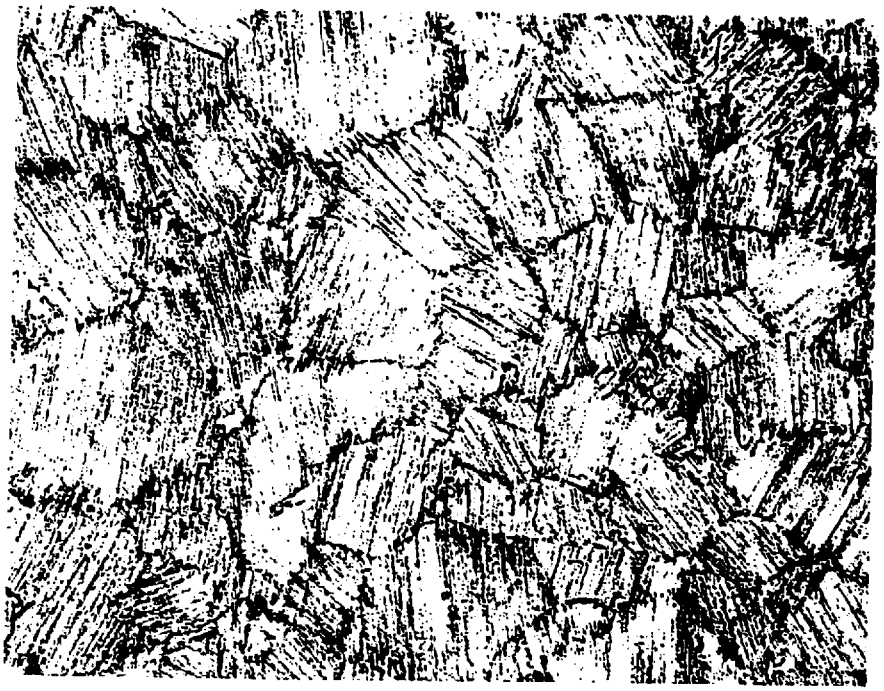
FIG. 8*a* shows a micrograph of PMTA-6 and FIG. 8*b* shows a micrograph of PMTA-7, both of which were hot extruded at 1380° C. (magnification 200×)
Figure 8B:
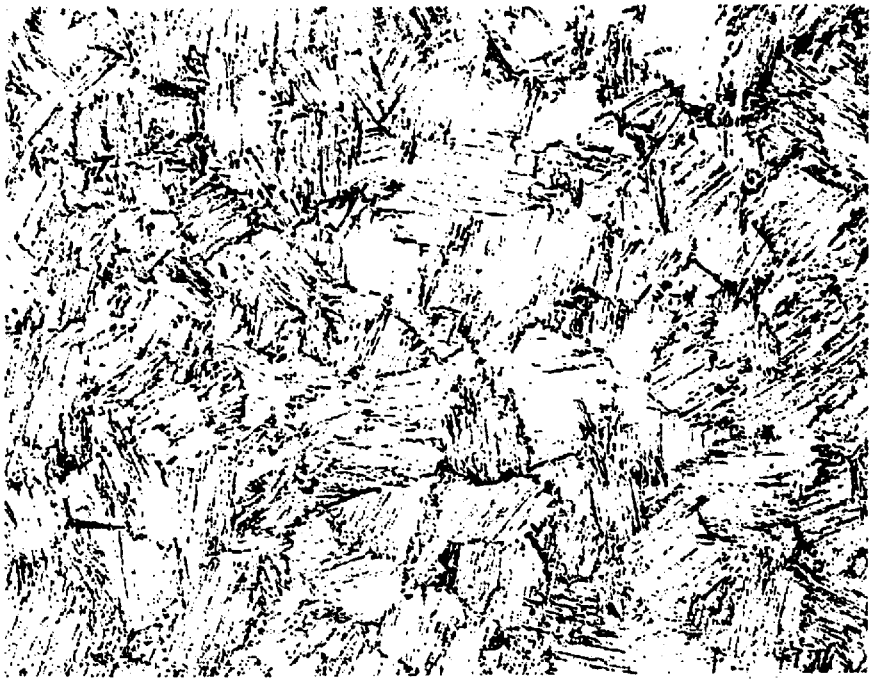
Figure 9A:
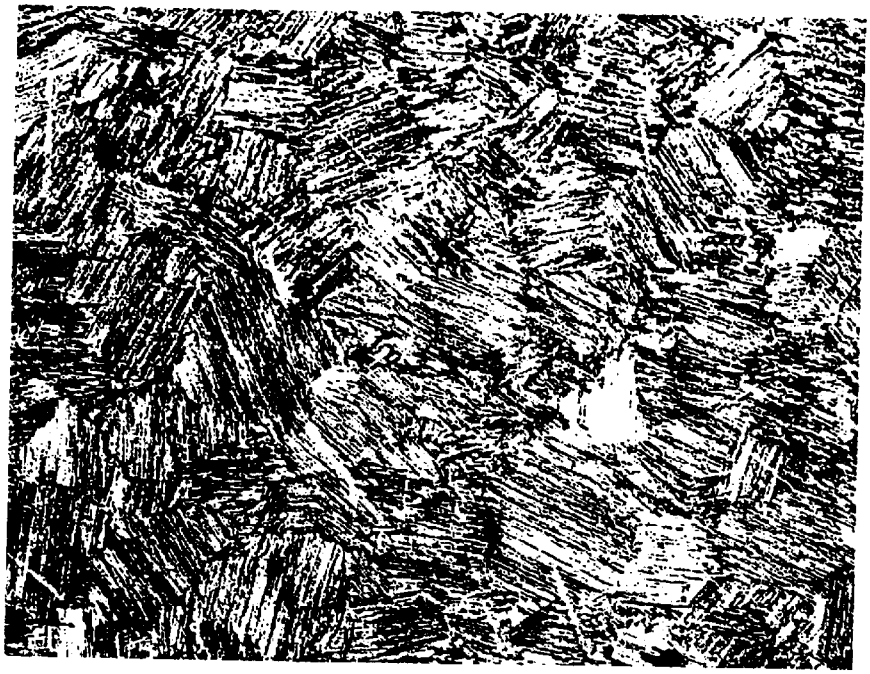
FIG. 9*a* is a micrograph of PMTA-6 and FIG. 9*b* is a micrograph of PMTA-7, both of which were hot extruded at 1365° C. (magnification 200×)
Figure 9B:
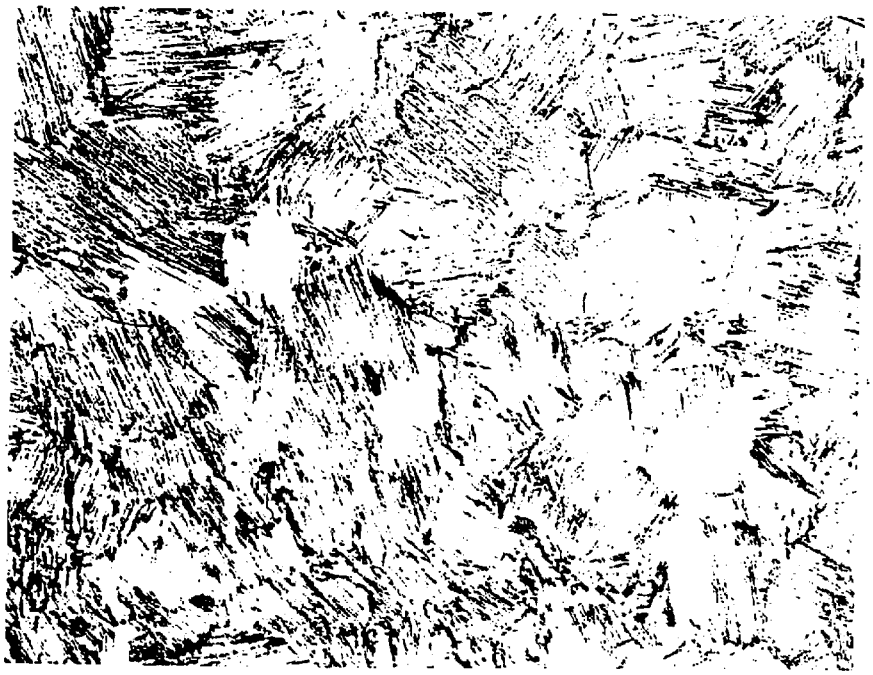

For comparison purposes, a 9-mil thick TiAl sheet (Ti-45Al-5Cr, at %) was evaluated. FIG. 7 shows the optical microstructures of the TiAlCr sheet in both as-received and annealed (3 days at 1000° C.) conditions.

Tensile sheet specimens with a thickness of 9–20 mils and a gage length of 0.5 in were sectioned from the hot extruded alloys rods after annealing for 2 hours at 1000° C., using a EDM machine. Some of the specimens were re-annealed up to 3 days at 1000° C. prior to tensile testing. Tensile tests were performed on an Instron testing machine at a strain rate of 0.1 inch/second at room temperature. Table 4 summarizes the tensile test results.

All the alloys stress-relieved for 2 hours at 1000° C. exhibited 1% or more tensile elongation at room temperature in air. The tensile elongation was not affected when the specimen thickness varied from 9 to 20 mils. As indicated in Table 4, among the 4 alloys, alloy PMTA-4 appears to have the best tensile ductility. It should be noted that a tensile elongation of 1.6% obtained from a 20-mil thick sheet specimen is equivalent to 4% elongation obtained from rod specimens with a gage diameter of 0.12 in. The tensile elongation appears to increase somewhat with annealing time at 1000° C., and the maximum ductility is obtained in the specimen annealed for 1 day at 1000° C.

All the alloys are exceptionally strong, with a yield strength of more than 100 ksi (700 MPa) and ultimate tensile strength more than 115 ksi (800 MPa) at room temperature. The high strength is due to the W and Nb additions and/or refined fully lamellar structures produced in these TiAl alloys. In comparison, the TiAlCr sheet material has a yield strength of only 61 ksi (420 MPa) at room temperature. Thus, the PMTA alloys are stronger than the TiAlCr sheet by as much as 67%. The PMTA alloys including 0.5% Mo exhibited significantly increased strengths, but slightly lower tensile elongation at room temperature.

Figure 10:
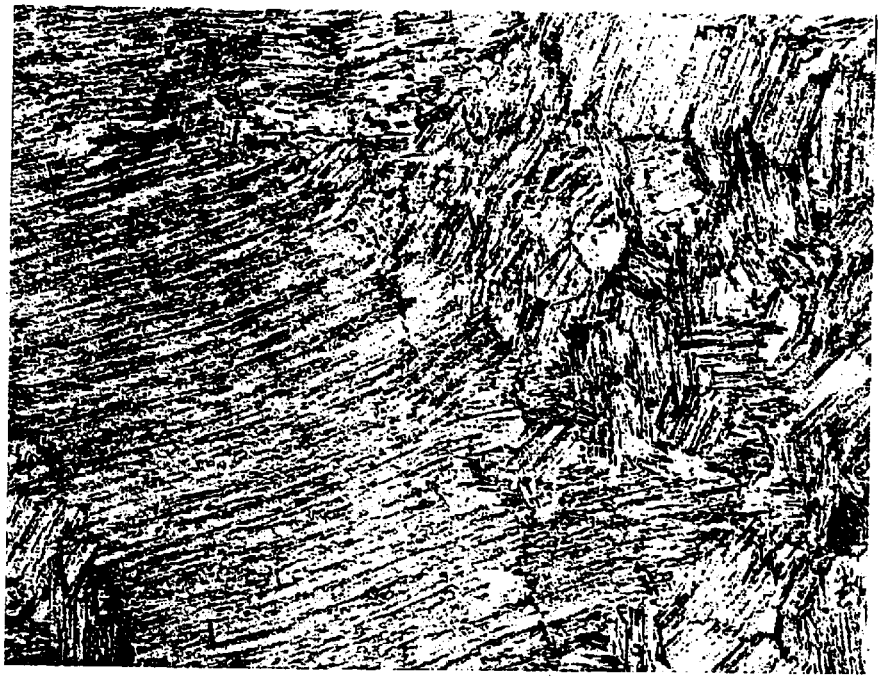
FIG. 10 is micrograph showing abnormal grain growth in PMTA hot extruded at 1380° C.

FIGS. 8*a–b* and 9*a–b* show the optical micrographs of PMTA-6 and 7 hot extruded at 1380° C. and 1365° C., respectively. Both alloys showed lamellar grain structures with little intercolony structures. Large colony grains (see FIG. 10) were observed in both alloys hot extruded at 1380° C. and 1365° C., which probably resulted from abnormal grain growth in the alloys containing low levels of boron after hot extrusion. There is no significant difference in microstructural features in these two PMTA alloys.

Figure 11A:
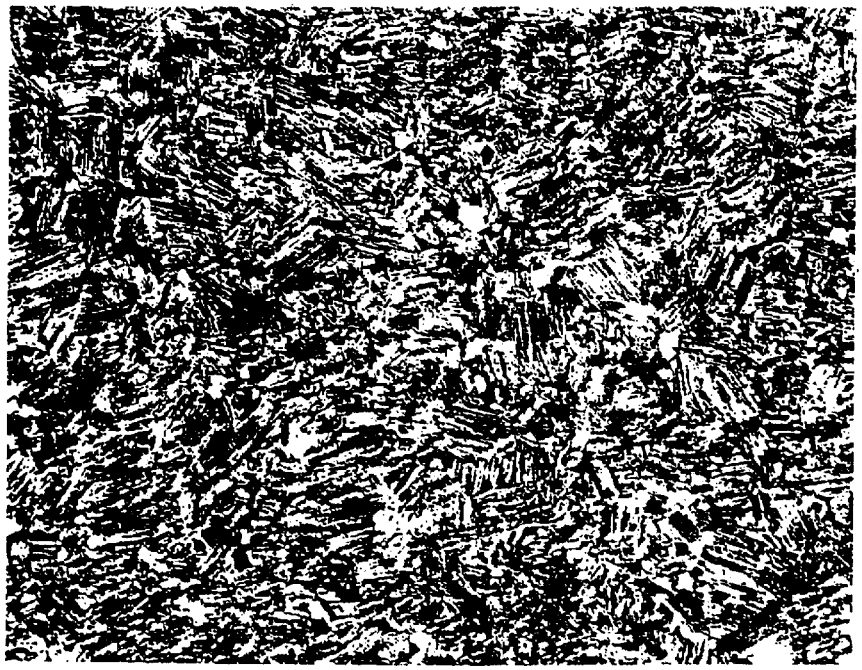
FIGS. 11*a–d* are micrographs of PMTA-8 heat treated at different conditions after hot extrusion at 1335° C., the heat treatments being two hours at 1000° C. for FIG. 11*a,* 30 minutes at 1340° C. for FIG. 11*b,* 30 minutes at 1320° C. for FIG. 11*c,* and 30 minutes at 1315° C. for FIG. 11*d* (magnification 200×)
Figure 11B:
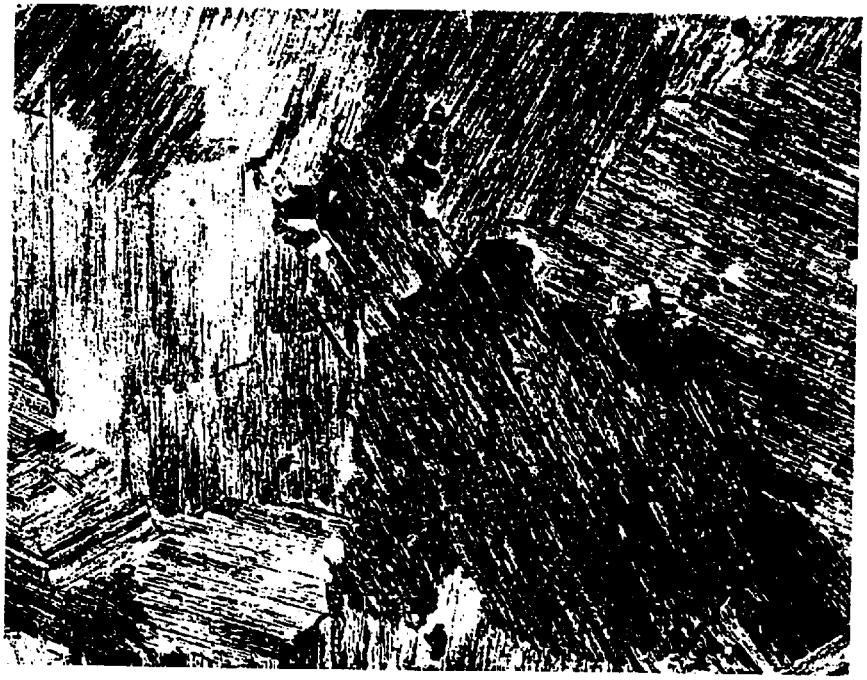
Figure 11C:
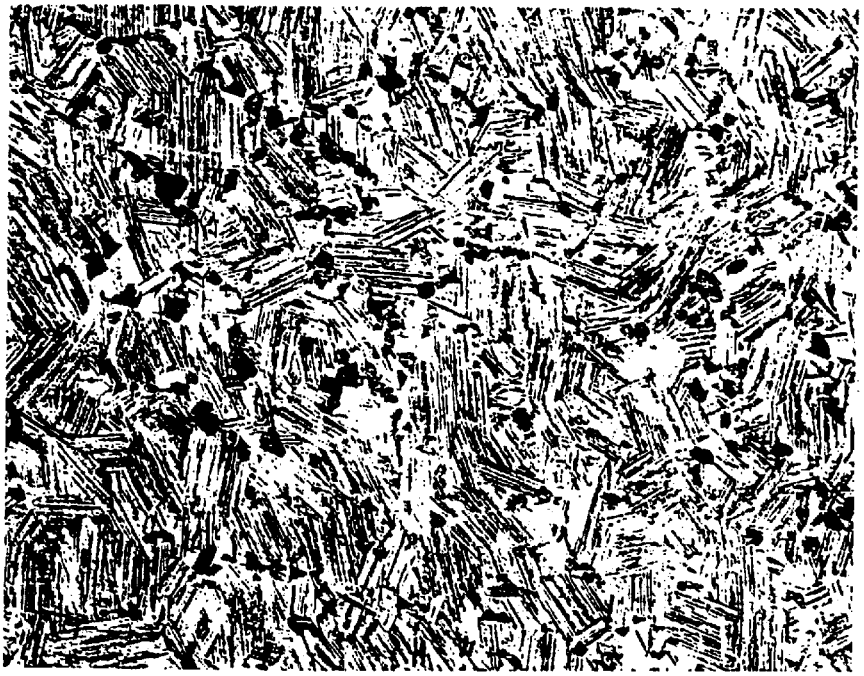
Figure 11D:
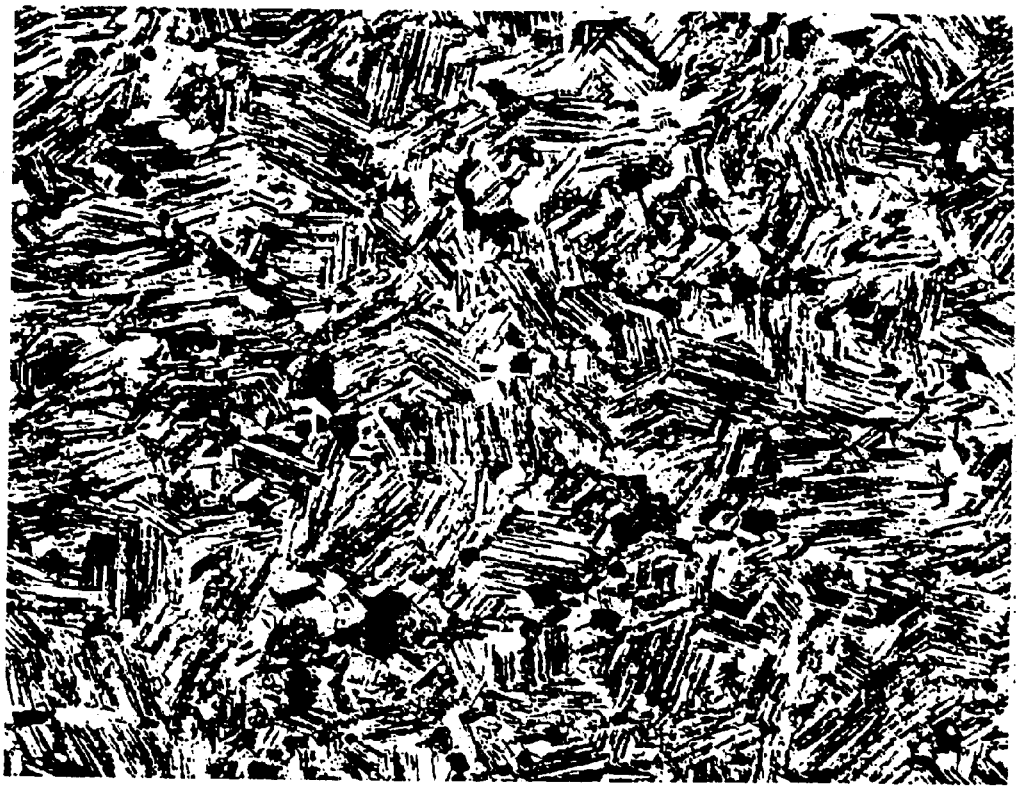

FIGS. 11*a–d* show the effect of heat treatment on microstructures of PMTA-8 hot extruded at 1335° C. The alloy extruded at 1335° C. showed much finer colony size and much more intercolony structures, as compared with those hot extruded at 1380° C. and 1365° C. Heat treatment for 2 h at 1000° C. did not produce any significant change in the as-extruded structure (FIG. 11*a*). However, heat treatment for 30 mins at 1340° C. resulted in a substantially larger colony structure (FIG. 11*b*). Lowering the heat-treatment temperature from 1340° C. to 1320–1315° C. (a difference by 20–25° C.) produced a sharp decrease in colony size, as indicated by FIGS. 11*c* and 11*d*. The annealing at 1320–1315° C. also appears to produce more intercolony structures in PMTA-8. The abnormal grain growth is almost completely eliminated by hot extrusion at 1335° C.

Tensile sheet specimens of PMTA-6 to 8 with a thickness varying from 8 to 22 mils and with a gage length of 0.5 inch were sectioned from the hot extruded alloy rods after giving a final heat treatment of 2 h at 1000° C. or 20 min at 1320–1315° C., using an EDM machine. Tensile tests were performed on an Instron testing machine at a strain rate of 0.1 in/s at temperatures up to 800° C. in air. All tensile results are listed in Tables 5 to 8. The alloys PMTA-4, -6 and -7 heat treated for 2 h at 1000° C. showed excellent strengths at all temperatures, independent of hot extrusion temperature. The hot extrusion at 1400–1365° C. gives low tensile ductilities (<4%) at room and elevated temperatures. A significant increase in tensile ductility is obtained at all temperatures when hot extruded at 1335° C. PMTA-8 which was hot extruded at 1335° C. exhibited the highest strength and tensile ductility at all test temperatures. There did not appear to be any systematical variation of tensile ductility with specimen thickness varying from 8 to 22 mils.

Tables 7 and 8 also show the tensile properties of PMTA-7 and 8 heat treated for 20 min. at 1320° C. and 1315° C., respectively. As compared with the results obtained from heat treatment at 1000° C., the heat treatment at 1320–1315° C. resulted in higher tensile elongation, but lower strength at the test temperatures. Among all the alloys and heat treatments, PMTA-8 hot extruded at 1335° C. and annealed for 20 min at 1315° C. exhibited the best tensile ductility at room and elevated temperatures. This alloy showed a tensile ductility of 3.3% and 11.7% at room temperature and 800° C., respectively. PMTA-8 heat treated at 1315° C. appears to be substantially stronger than known TiAl alloys.

In an attempt to demonstrate the bend ductility of TiAl sheet material, several pieces of 11 to 20 mil PMTA-7 and PMTA-8 alloy sheets, produced by hot extrusion and heat treated at 1320° C., were bent at room temperature. Each alloy piece did not fracture after a bend of 42°. These results clearly indicate that PMTA alloys with a controlled microstructure is bendable at room temperature.

The oxidation behavior of PMTA-2, -5 and -7 was studied by exposing sheet samples (9–20 mils thick) at 800° C. in air. The samples were periodically removed from furnaces for weight measurement and surface examination. The samples showed a very low weight gain without any indication of spalling. It appears that the alloying additions of W and Nb affect the oxidation rate of the alloys at 800° C., and W is more effective in improving the oxidation resistance of TiAl alloys. Among the alloys, PMTA-7 exhibits the lowest weight gain and the best oxidation resistance at 800° C. Oxidation of PMTA-7 indicated that oxide scales are fully adherent with no indication of microcracking and spalling. This observation clearly suggests that the oxide scales formed at 800° C. are well adherent to the base material and are very protective.

Figure 12:
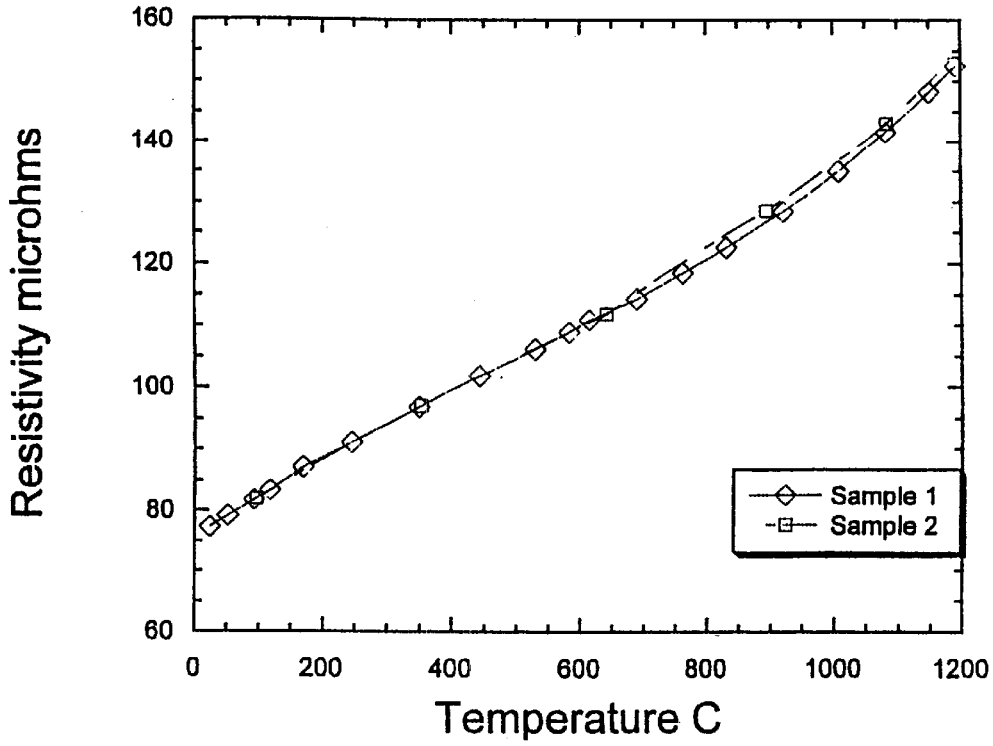
FIG. 12 is a graph of resistivity in microhms versus temperature for samples 1 and 2 cut from an ingot having a PMTA-4 nominal composition.
Figure 13:
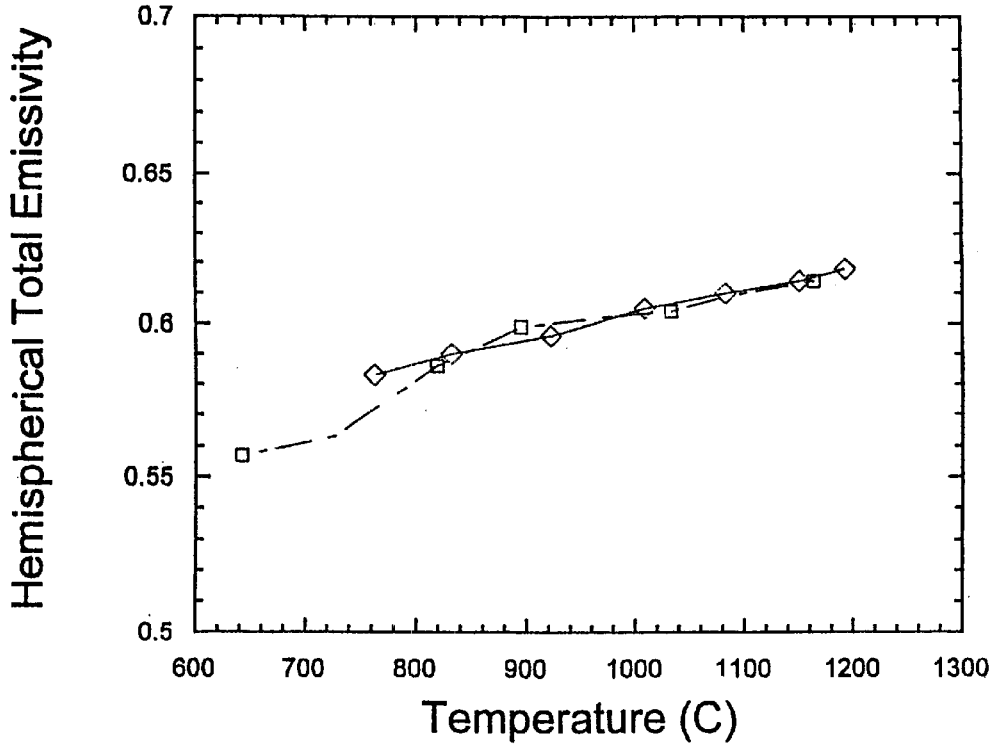
FIG. 13 is a graph of hemispherical total emissivity versus temperature for samples 1 and 2.
Figure 14:
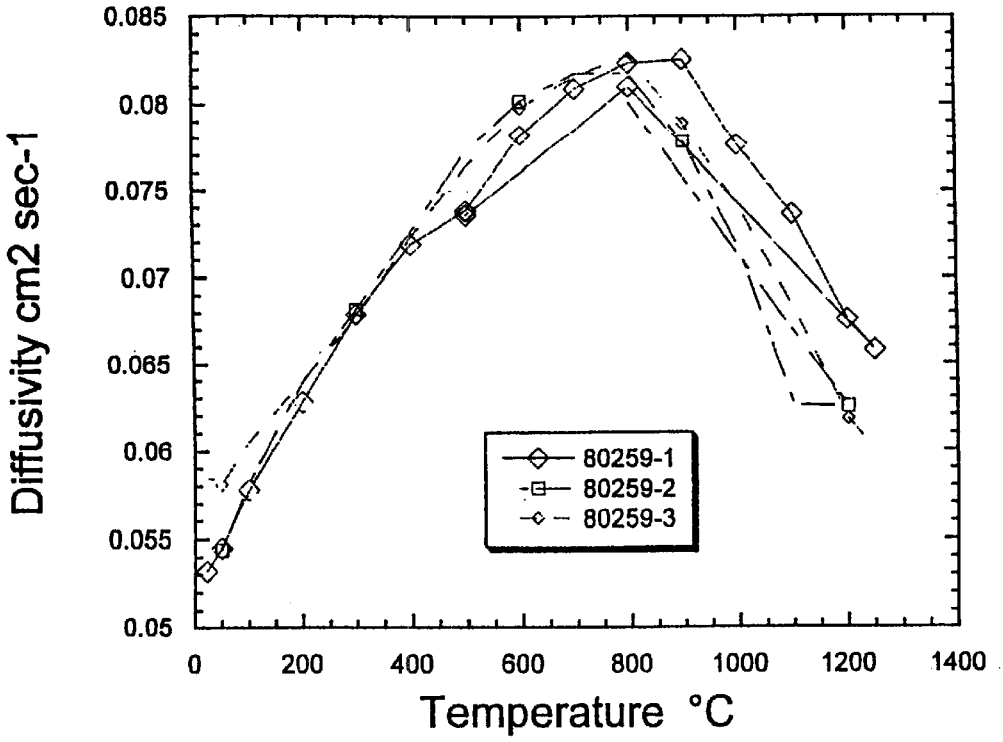
FIG. 14 is a graph of diffusivity versus temperature for samples 80259-1, 80259-2 and 80259-3 cut from the same ingot as samples 1 and 2.
Figure 15:
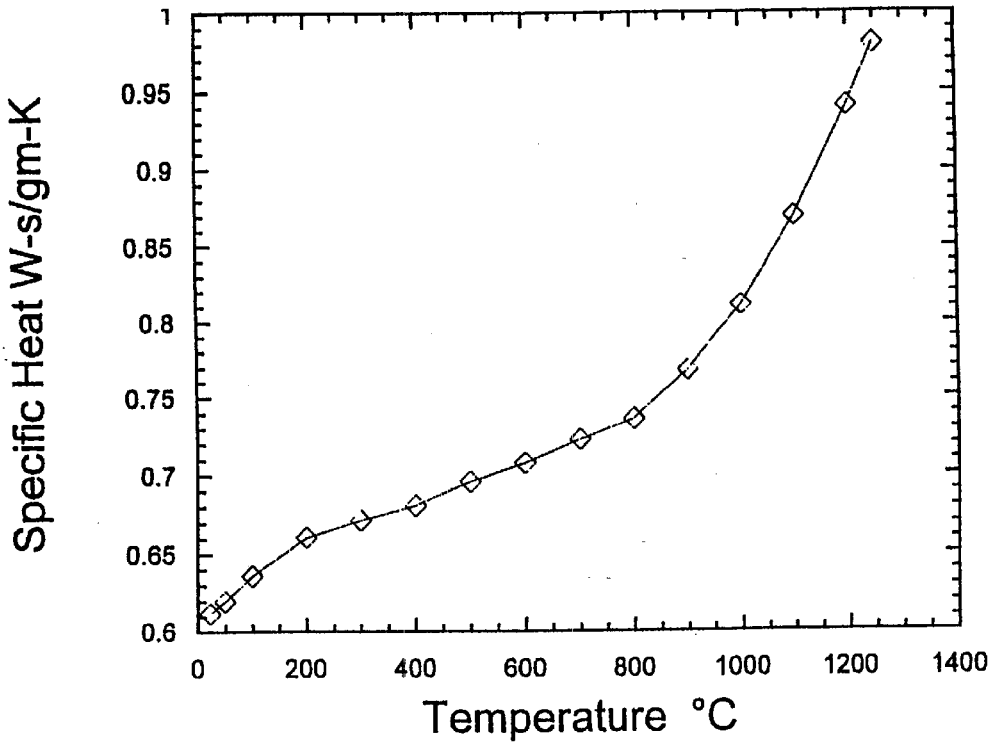
FIG. 15 is a graph of specific heat versus temperature for titanium aluminide in accordance with the invention.
Figure 16:
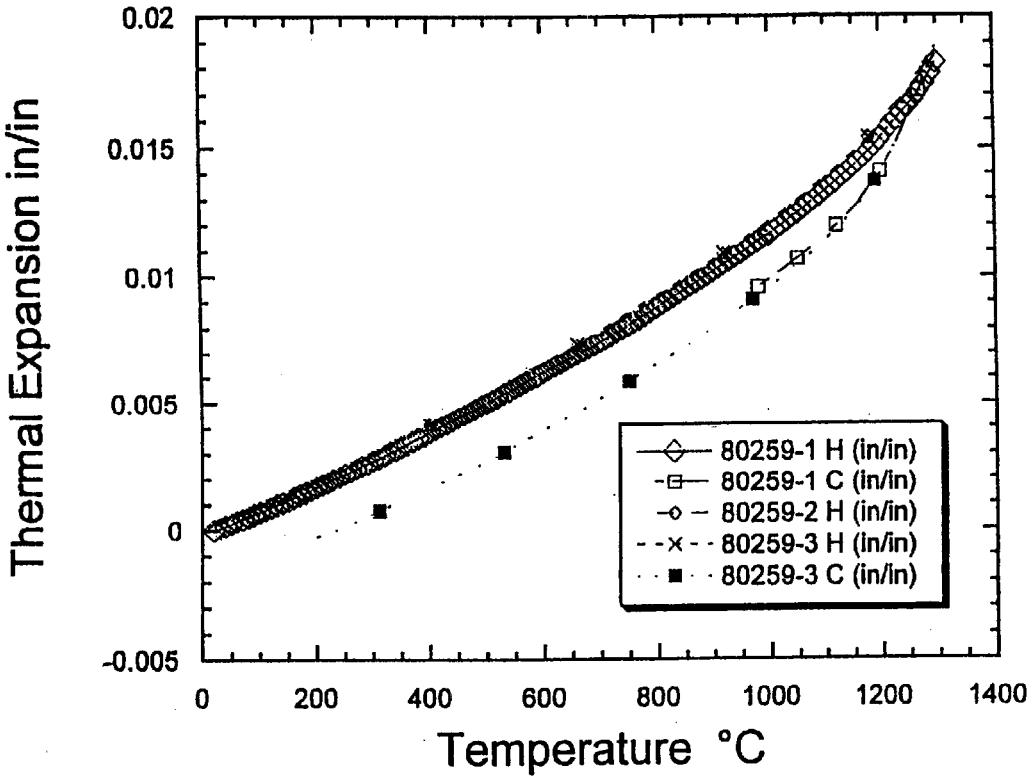
FIG. 16 is a graph of thermal expansion versus temperature for samples 80259-1H, 80259-1C, 80259-2H, 80259-3H, and 80259-3C cut from the same ingot as samples 1 and 2.

FIG. 12 is a graph of resistivity in microhms versus temperature for samples 1 and 2 which were cut from an ingot having a nominal composition of PMTA-4, i.e. 30.8 wt % Al, 7.1 wt % Nb, 2.4 wt % W, and 0.045 wt % B; FIG. 13 is a graph of hemispherical total emissivity versus temperature for samples 1 and 2; FIG. 14 is a graph of diffusivity versus temperature for samples 80259-1, 80259-2 and 80259-3 cut from the same ingot as samples 1 and 2; FIG. 15 is a graph of specific heat versus temperature for titanium aluminide in accordance with the invention; and FIG. 16 is a graph of thermal expansion versus temperature for samples 80259-1H, 80259-1C, 80259-2H, 80259-3H, and 80259-3C cut from the same ingot as samples 1 and 2.

In summary, the PMTA alloys hot extruded at 1365 to 1400° C. exhibited mainly lamellar structures with little intercolony structures while PMTA-8 extruded at 1335° C. showed much finer colony structures and more intercolony structures. The heat treatment of PMTA-8 at 1315–1320° C. for 20 min. resulted in fine lamellar structures. The alloys may include (Ti, W, Nb) borides formed at colony boundaries. Moreover, tungsten in the hot-extruded alloys is not uniformly distributed, suggesting the possibility of high electrical resistance of TiAl alloys containing W additions. The inclusion of 0.5 at % Mo significantly increases the yield and ultimate tensile strengths of the TiAl alloys, but lowers the tensile elongation to a certain extent at room temperature. Among the four hot extruded alloys PMTA 1–4, PMTA-4 with the alloy composition Ti-46.5 Al-3 Nb-0.5 W-0.2 B (at %) has the best combination of tensile ductility and strength at room temperature. In comparison with the TiAlCr sheet material (Ti-45 Al-5Cr), PMTA-4 is stronger than the TiAlCr sheet by 67%. In addition, the TiAlCr sheet showed no bend ductility at room temperature while PMTA-4 has an elongation of 1.4%. The tensile elongation of TiAl alloys is independent of sheet thickness in the range of 9 to 20 mils. The alloys PMTA 4, 6 and 7 heat treated at 1000° C. for 2 h showed excellent strength at all temperatures up to 800° C., independent of hot extrusion temperature. Hot extrusion temperatures of 1400–1365° C., however, provides lower tensile ductilities (<4%) at room and elevated temperatures. A significant increase in tensile ductility is obtained at all temperatures when the extrusion temperature is 1335° C. PMTA-8 (Ti-46.5 Al-3 Nb-1W-0.5B) hot extruded at 1335° C. and annealed at 1315° C. for 20 min. exhibited the best tensile ductility at room and elevated temperatures (3.3% at room temperature and 11.7% at 800° C.).

TABLE 1

Nominal Alloy Compositions

| Alloy number | Compositions (at %) Ti | Al | Cr | Nb | Mo | W | B |
|---|---|---|---|---|---|---|---|
| PMTA-1 | 50.35 | 46.5 | 0 | 2 | 0.5 | 0.5 | 0.15 |
| PMTA-2 | 50.35 | 46.5 | 0 | 2 | — | 1.0 | 0.15 |
| PMTA-3 | 49.85 | 46.5 | 0 | 2 | 0.5 | 1.0 | 0.15 |

TABLE 1-continued

Nominal Alloy Compositions

| Alloy number | Compositions (at %) Ti | Al | Cr | Nb | Mo | W | B |
|---|---|---|---|---|---|---|---|
| PMTA-4 | 49.85 | 46.5 | 0 | 3 | — | 0.5 | 0.15 |
| PMTA-5 | 47.85 | 46.5 | 0 | 4 | — | 0.5 | 0.15 |
| PMTA-6 | 49.92 | 46.5 | 0 | 3 | — | 0.5 | 0.08 |
| PMTA-7 | 49.92 | 46.5 | 0 | 3 | — | 1.0 | 0.08 |
| PMTA-8 | 49.40 | 46.5 | 0 | 3 | — | 1.0 | 0.10 |
| PMTA-9 | 49.32 | 46.5 | 0 | 3 | — | 1.0 | 0.18 |
| PMTA-1 | 60.46 | 31.36 | 0 | 4.64 | 1.20 | 2.30 | 0.04 |
| PMTA-2 | 59.80 | 31.02 | 0 | 4.60 | — | 4.54 | 0.04 |
| PMTA-3 | 58.86 | 30.83 | 0 | 4.57 | 1.18 | 4.52 | 0.04 |
| PMTA-4 | 59.55 | 31.19 | 0 | 6.93 | — | 2.29 | 0.04 |
| PMTA-5 | 57.71 | 30.85 | 0 | 9.14 | — | 2.26 | 0.04 |
| PMTA-6 | 59.56 | 31.20 | 0 | 6.93 | — | 2.29 | 0.02 |
| PMTA-7 | 57.98 | 30.68 | 0 | 6.82 | — | 4.50 | 0.02 |
| PMTA-8 | 57.98 | 30.68 | 0 | 6.82 | — | 4.50 | 0.02 |
| PMTA-9 | 57.97 | 30.67 | 0 | 6.82 | — | 4.49 | 0.05 |

TABLE 2

Fabrication and Heat Treatment Condition Used for PMTA Alloys

| Alloy number | Hot extrusion temperature (C. °) | Heat treatment (C. °/time) |
|---|---|---|
| PMTA-1 | 1400 | 1000° C. for up to 3 days |
| PMTA-2 | 1400 | 1000° C. for up to 3 days |
| PMTA-3 | 1400 | 1000° C. for up to 3 days |
| PMTA-4 | 1400 | 1000° C. for up to 3 days |
| PMTA-5 | | |
| PMTA-6 | 1380, 1365 | 1000° C./2 hours |
| PMTA-7 | 1380, 1365 | 1000° C./2 hr, 1320° C./20 min |
| PMTA-8 | 1335 | 1000° C./2 hr, 1315° C./20 min |

TABLE 3

Phase Compositions in PMTA-2 Alloy Determined by Electron Microprobe Analyses

| Phase | Alloy elements (at %) Ti | Al | W | Nb |
|---|---|---|---|---|
| Matrix phase (dark contrast) | Balance | 44.96 | 0.82 | 1.32 |
| Matrix phase (bright contrast) | Balance | 44.70 | 1.15 | 1.32 |
| Borides* | 77.69 | 8.66 | 9.98 | 3.67 |

*metal elements only

TABLE 4

Tensile Properties of PMTA Alloys Hot Extruded at 1400° C. and Tested at Room Temperature

| Alloy number | Composition Nb—Mo—W (at %) | Tensile elongation (%) | $\sigma_y$ (ksi) | $\sigma_{ue}$ (ksi) |
|---|---|---|---|---|
| 2 hours/1000° C. | | | | |
| PMTA-1 | 2/0.5/0.5 | 1.0 | 114 | 118 |
| PMTA-2 | 2/0/1.0 | 1.2 | 104 | 117 |
| PMTA-3 | 2/0.5/1.0 | 1.1 | 123 | 132 |
| PMTA-4 | 3/0/0.5 | 1.4 | 102 | 115 |

TABLE 4-continued

Tensile Properties of PMTA Alloys Hot Extruded at 1400° C. and Tested at Room Temperature

| Alloy number | Composition Nb—Mo—W (at %) | Tensile elongation (%) | $\sigma_y$ (ksi) | $\sigma_{ue}$ (ksi) |
|---|---|---|---|---|
| | 1 day/1000° C. | | | |
| PMTA-3 | 2/0.5/1.0 | 1.4 | 115 | 131 |
| | 3 days/1000° C. | | | |
| PMTA-2 | 2/0/1.0 | 0.8 | 105 | 109 |

TABLE 5

Tensile Properties of PMTA-4 Hot Extruded at 1400° C. and Annealed for 2 h at 1000° C.

| Test temperature (C. °) | Yield strength (ksi) | Ultimate tensile strength (ksi) | Elongation (%) |
|---|---|---|---|
| 22 | 102.0 | 115 | 1.4 |
| 600 | 101.0 | 127 | 2.4 |
| 700 | 96.5 | 130 | 2.7 |
| 800 | 97.8 | 118 | 2.4 |

TABLE 6

Tensile Properties of PMTA-6 Hot Extruded at 1365° C. and Annealed at 1000° C. for 2 h

| Test temperature (C. °) | Yield strength (ksi) | Ultimate tensile strength (ksi) | Elongation (%) |
|---|---|---|---|
| 22 | 121.0 | 136 | 1.3 |
| 300 | 101.0 | 113 | 1.2 |
| 700 | 93.6 | 125 | 2.7 |
| 800 | 86.5 | 125 | 3.9 |

TABLE 7

Tensile Properties of PMTA-7 Hot Extruded at 1365° C.

| Test temperature (C. °) | Yield strength (ksi) | Ultimate tensile strength (ksi) | Elongation (%) |
|---|---|---|---|
| | Annealed for 2 h at 1000° C. | | |
| 22 | 116.0 | 122 | 1.0 |
| 300 | 101.0 | 116 | 1.5 |
| 700 | 105.0 | 131 | 2.7 |
| 800 | 87.2 | 121 | 3.1 |
| | Annealed for 20 min at 1320° C. | | |
| 20 | 84.5 | 106.0 | 3.0 |
| 300 | 71.4 | 89.8 | 2.5 |
| 700 | 68.5 | 97.2 | 4.5 |
| 800 | 63.5 | 90.2 | 4.5 |

TABLE 8

Tensile Properties of PMTA-8 Hot Extruded at 1335° C.

| Test temperature (C. °) | Yield strength (ksi) | Ultimate tensile strength (ksi) | Elongation (%) |
|---|---|---|---|
| | Annealed for 2 h at 1000° C. | | |
| 22 | 122.0 | 140 | 2.0 |
| 300 | 102.0 | 137 | 4.3 |
| 700 | 95.0 | 131 | 4.7 |
| 800 | 90.2 | 124 | 5.6 |
| | Annealed for 20 min at 1315° C. | | |
| 20 | 96.2 | 116 | 3.3 |
| 300 | 79.4 | 115 | 6.1 |
| 700 | 72.2 | 112 | 7.5 |
| 800 | 72.0 | 100 | 11.7 |

The foregoing titanium aluminide can be manufactured into various shapes or products such as electrical resistance heating elements. However, the compositions disclosed herein can be used for other purposes such as in thermal spray applications wherein the compositions could be used as coatings having oxidation and corrosion resistance. Also, the compositions could be used as oxidation and corrosion resistant electrodes, furnace components, chemical reactors, sulfidization resistant materials, corrosion resistant materials for use in the chemical industry, pipe for conveying coal slurry or coal tar, substrate materials for catalytic converters, exhaust walls and turbocharger rotors for automotive and diesel engines, porous filters, etc.

With respect to resistance heating elements, the geometry of the heating element blades can be varied to optimize heater resistance according to the formula: $R=\rho(L/W\times T)$ wherein R=resistance of the heater, ρ=resistivity of the heater material, L=length of heater, W=width of heater and T=thickness of heater. The resistivity of the heater material can be varied by changes in composition such as adjusting the aluminum content of the heater material, processing or by incorporation of alloying additions. For instance, the resistivity can be significantly increased by incorporating particles of alumina in the heater material. The heater material can optionally include ceramic particles to enhance creep resistance and/or thermal conductivity. For instance, the heater material can include particles or fibers of electrically conductive material such as nitrides of transition metals (Zr, Ti, Hf), carbides of transition metals, borides of transition metals and $MoSi_2$ for purposes of providing good high temperature creep resistance up to 1200° C. and also excellent oxidation resistance. The heater material may also incorporate particles of electrically insulating material such as $Al_2O_3$, $Y_2O_3$, $Si_3N_4$, $ZrO_2$ for purposes of making the heater material creep resistant at high temperature and also improving thermal conductivity and/or reducing the thermal coefficient of expansion of the heater material. The electrically insulating/conductive particles/fibers can be added to a powder mixture of Fe, Al, Ti or iron aluminide or such particles/fibers can be formed by reaction synthesis of elemental powders which react exothermically during manufacture of the heater element.

Table 9 sets forth a general comparison of property data published in 1998 by Y. W. Kim comparing titanium base alloys, TiAl base alloys and superalloys. In the property data for the TiAl base alloys and superalloys, "a" designates a duplex microstructure, "b" designates a lamellar microstructure, "*" designates an uncoated material and "**" designates a coated material. As shown, the TiAl-base alloys provide a desirable combination of properties while exhibiting lower density than the Ti-base and superalloys.

TABLE 9

Properties of Ti-base, TiAl-base and Superalloys

| Property | Ti-Base Alloys | TiAl-Base Alloys | Superalloys |
|---|---|---|---|
| Structure | hcp/bcc | L10 | fcc/L12 |
| Density (g/cm$^3$) | 4.5 | 3.7–3.9 | 7.9–8.5 |
| Modulus (GPa) | 95–115 | 160–180 | 206 |
| YS (MPa) | 380–1150 | 350–850 | 800–1200 |
| UTS (MPa) | 480–1200 | 400–1000 | 1250–1450 |
| % Ductility (RT) | 10–25 | 1–5 | 3–25 |
| % Ductility (° C.) | 12–50 (550) | 10–60 (870) | 20–80 (870) |
| Fracture (MPa/m) | 30-60 | 10–25 | 30–90 |
| Creep Limit (° C.) | 500 | 700a–870b | 800–1090 |
| Oxidation (° C.) | 550 | 750*–900** | 870*–1090** |

Figure 17:
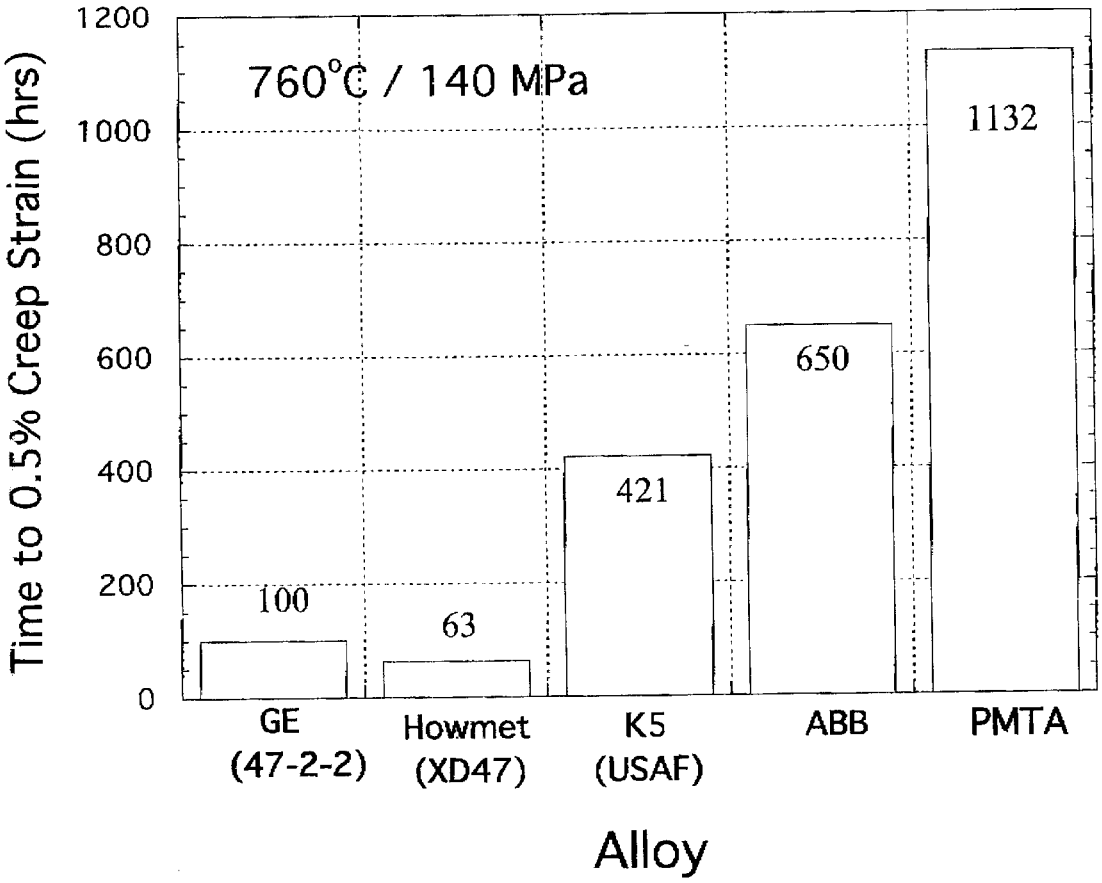
FIG. 17 is a graph of creep resistance comparing PMTA 8 (Ti-46.5% Al-3% Nb-1% W-0.1% B) to commercial high temperature materials GE (Ti-47Al-2Nb-2Cr), Howmet XD47 (Ti-47 Al-2Nb-2Mn-0.8 vol % $TiB_2$), USAF K5 (Ti-46.5Al-2Cr-3Nb-0.2W) and ABB (Ti-47Al-2W-0.5Si)

As shown in FIG. 17, PMTA 8 (Ti-46.5% Al-3% Nb-1% W-0.1% B) exhibits exceptional creep resistance compared to commercial high temperature materials GE (Ti-47Al-2Nb-2Cr), Howmet XD47 (Ti-47 Al-2Nb-2Mn-0.8 vol % $TiB_2$), USAF K5 (Ti-46.5Al-2Cr-3Nb-0.2W) and ABB (Ti-47Al-2W-0.5Si). Of these, GE designates a cast duplex alloy, XD 47 designates a cast near-lamellar alloy, TAB designates a wrought duplex alloy, K5 designates a wrought refined fully lamellar alloy, and ABB designates a cast near-lamellar alloy.

Figure 18:
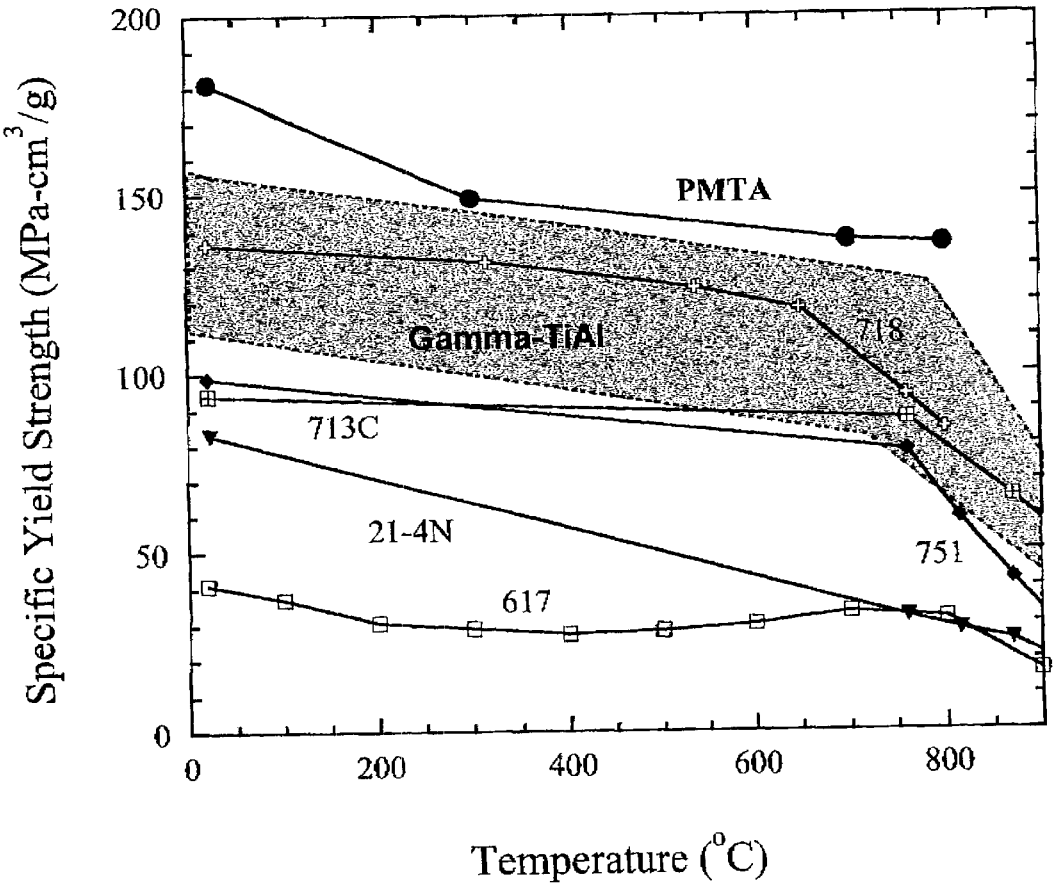
FIG. 18 is a graph of specific yield strength versus temperature properties for IMI 834, IN 625, IN 718, IN 617, and PMTA 8.
Figure 19:
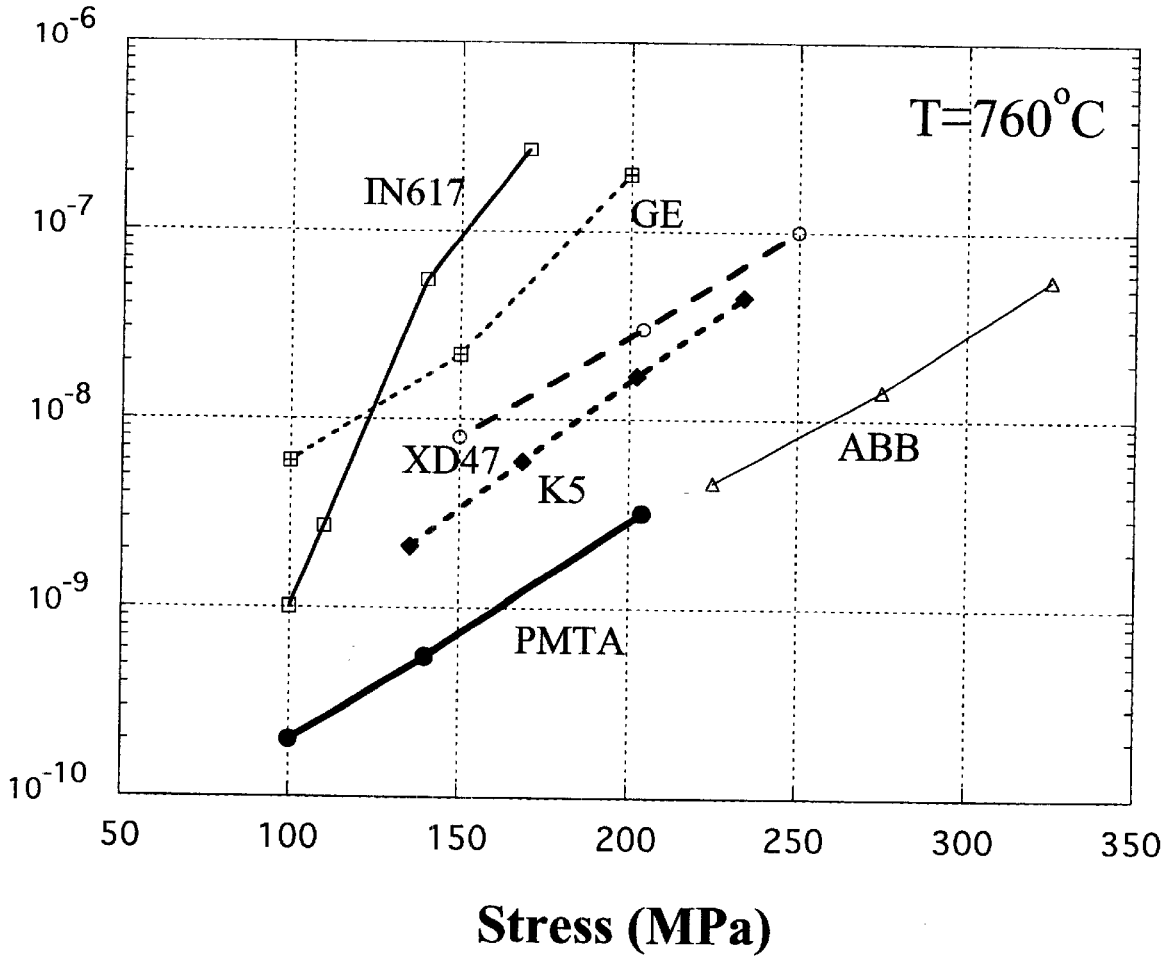
FIG. 19 is a graph of minimum creep rate versus stress properties for GE, IN 617, XD47, K5 and PMTA 8.
Figure 20:
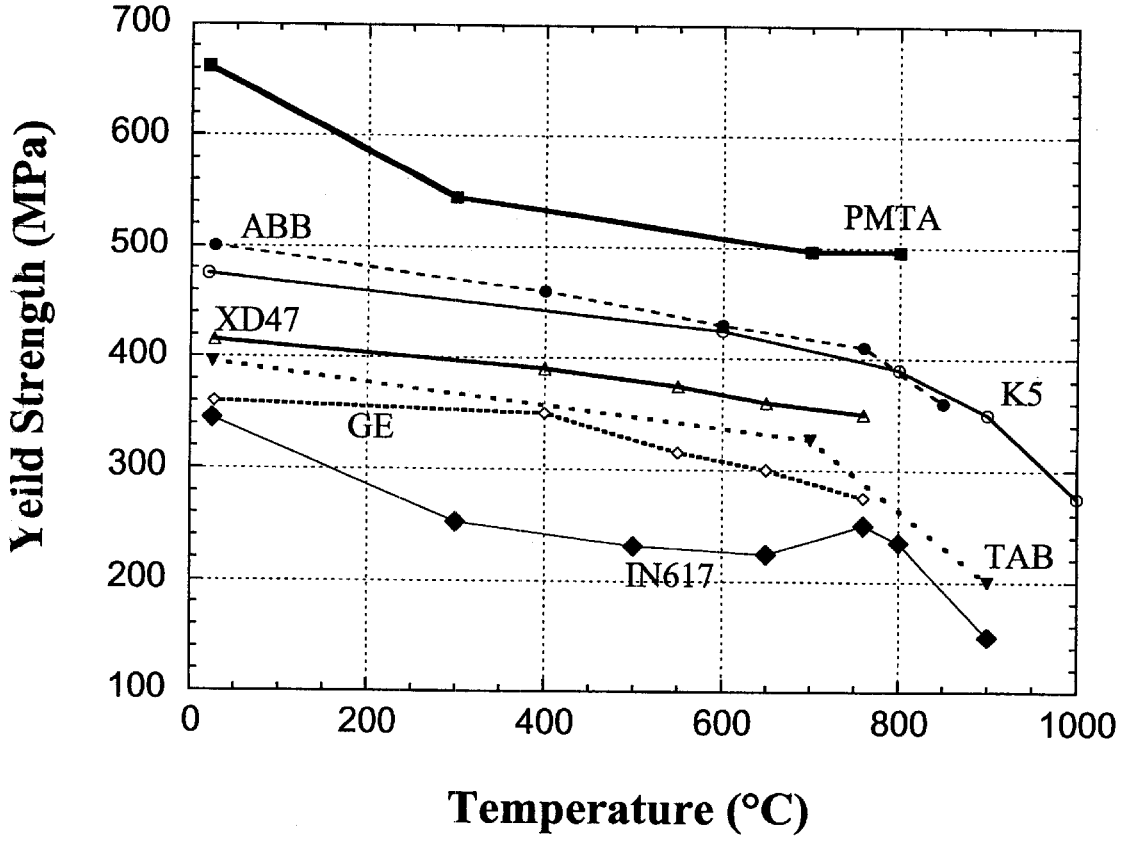
FIG. 20 is a graph of yield strength versus temperature properties for IN 617, GE, TAB, XD 47, K5, and PMTA 8.
Figure 21:
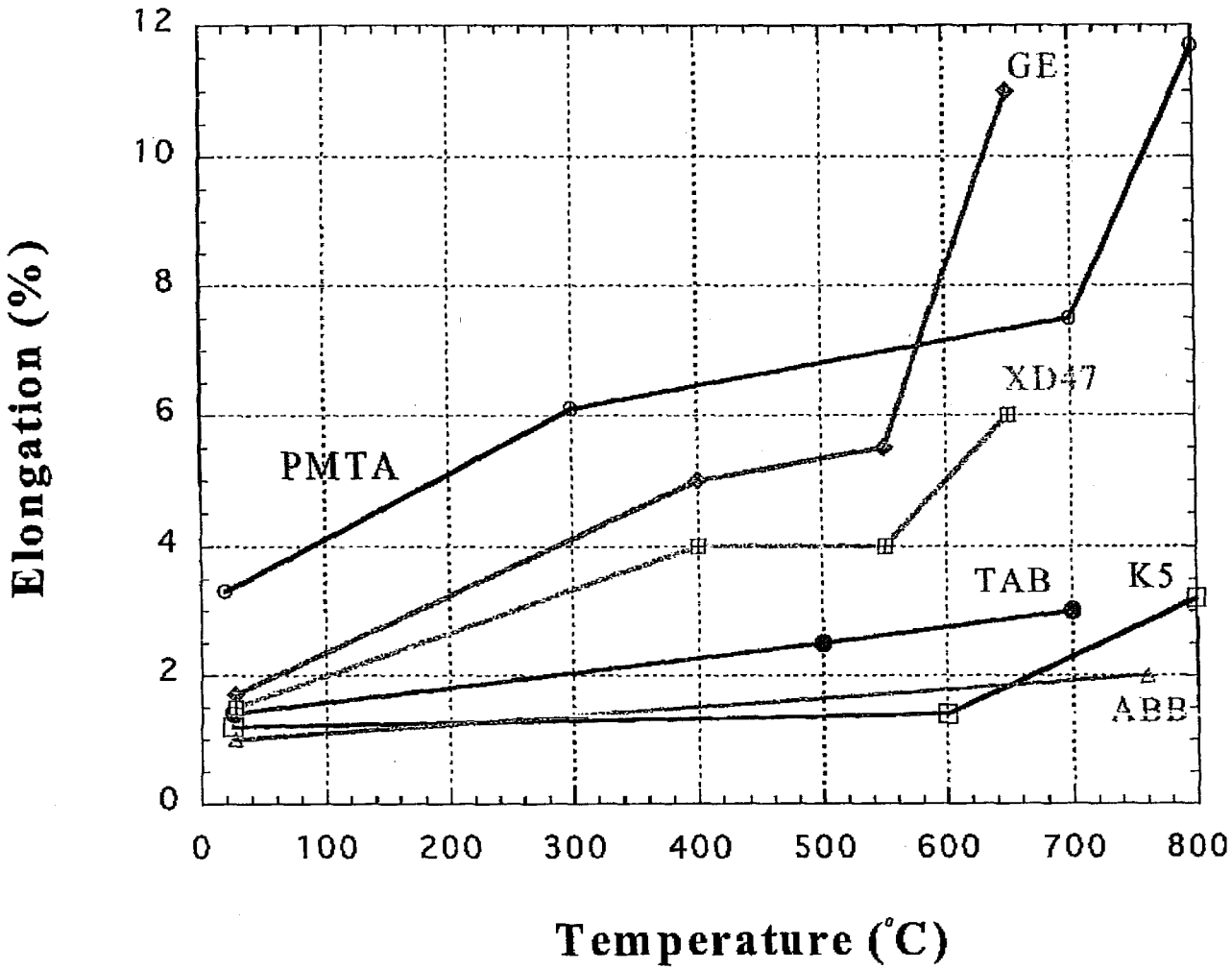
FIG. 21 is a graph of elongation versus temperature properties for K5, ABB, TAB, XD47, GE and PMTA.

FIG. 18 shows a comparison of specific yield strength versus temperature properties for IMI 834, IN 625, IN 718, IN 617, and PMTA 8. FIG. 19 is a graph of minimum creep rate versus stress properties for GE, IN 617, XD47, K5 and PMTA 8 wherein it can be seen that PMTA 8 exhibits the best properties over the stress range of about 150 to 200 MPa. FIG. 20 is a graph of yield strength versus temperature properties for IN 617, GE, TAB, XD 47, K5, and PMTA 8 wherein it can be seen that PMTA 8 exhibits the best properties over the temperature range of room temperature to 800° C. FIG. 21 is a graph of elongation versus temperature properties for K5, ABB, TAB, XD47, GE and PMTA wherein it can be seen that PMTA exhibits the best properties over the temperature range of room temperature to 800° C. for all alloys except GE which exhibited better elongation around 600° C.

PMTA alloys compare favorably to the commercially available alloys mentioned above. Other TiAl-base alloys in accordance with the invention which allow the service life of the alloys to be increased to 800° C. and 900° C. include Ti-46.5Al-8Nb-0.2W-0.5B, Ti-46.5Al-8Nb-0.2W-0.5B-0.15C, Ti-46.5Al-8Nb-0.2W-0.05B, Ti-46.5Al-8Nb-0.5W-0.5B, Ti-46.5Al-8Nb-0.5W-0.05B-0.07C, and Ti-47.5Al-8Nb-0.5W-0.05B.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A Cr-free and Mn-free titanium aluminide alloy consisting essentially of, in weight %, 50 to 65% Ti, 25 to 35% Al, 2 to 20% Nb, 0.5 to 10% W and/or Ta, and 0.01 to 0.5% B, the titanium aluminide alloy having a room temperature yield strength of more than 80 ksi (560 MPa) and a room temperature tensile elongation of at least 1%.

2. The titanium aluminide alloy of claim 1, in an as-cast, hot extruded, cold worked, or heat treated condition.

3. The titanium aluminide alloy of claim 1, wherein the alloy has a two-phase nearly fully lamellar microstructure with fine particles located at colony boundaries.

4. The titanium aluminide alloy of claim 1, wherein fine boride particles are located at the colony boundaries.

5. The titanium aluminide alloy of claim 4, wherein fine second-phase particles are located at the colony boundaries.

6. The titanium aluminide alloy of claim 1, wherein the alloy has a two-phase microstructure including grain-boundary equiaxed structures.

7. The titanium aluminide alloy of claim 1, wherein the Al content is 45 to 47 atomic %, the Nb content is 4 to 10 atomic %, the W content is 0.1 to 0.8 atomic % and the B content is 0.02 to 0.8 atomic %.

8. The titanium aluminide alloy of claim 1, having an ultimate tensile strength of more than 90 ksi (680 MPa).

9. The titanium aluminide alloy of claim 1, wherein the alloy has a microstructure in which W is distributed non-uniformly.

10. The titanium aluminide alloy of claim 1, wherein aluminum is present in an amount of about 46 to 47 atomic %.

11. The titanium aluminide alloy of claim 1, wherein the alloy has a lamellar microstructure substantially free of equiaxed structures at colony boundaries.

12. The titanium aluminide alloy of claim 1, wherein the alloy does not include Mo.

13. The titanium aluminide alloy of claim 1, wherein the Al content is 46 to 48 atomic %, the Nb content is 7 to 9 atomic %, the W content is 0.1 to 0.6 atomic % and the B content is 0.04 to 0.6 atomic %.

14. The titanium aluminide alloy of claim 1, including 45 to 55 at % Ti, 40 to 50 at % Al, 1 to 10 at % Nb, 0.1 to 1.5 at % W, and 0.05 to 0.5 at % B.

15. The titanium aluminide alloy of claim 1, comprising a sheet with a thickness of 8 to 30 mils.

16. The titanium aluminide alloy of claim 1, free of Cr, V, Mn, Co, Cu and Ni.

17. The titanium aluminide alloy of claim 1, comprising TiAl with 6 to 10 at % Nb, 0.2 to 0.5 at % W, and 0.05 to 0.5 at % B.

18. The titanium aluminide alloy of claim 1, including 1 to 9 at % Nb, ≦1 at % Mo and 0.2 to 2 at % W.

19. The titanium aluminide alloy of claim 1, wherein the alloy exhibits a creep rate of less than about $5\times10^{-10}$ under a stress of 100 MPa.

20. The titanium aluminide alloy of claim 1, wherein the alloy exhibits a creep rate of less than about $10^{-9}$ stress of 150 MPa.

21. The titanium aluminide alloy of claim 1, wherein the alloy exhibits a creep rate of less than about $10^{-8}$ under a stress of 200 MPa.

22. The titanium aluminide alloy of claim 1, wherein the alloy exhibits a time to 0.5% creep strain of at least 1000 hours under a stress of 140 MPa and a temperature of 760° C.

23. A titanium aluminide alloy consisting essentially of, in weight %, 50 to 65% Ti, 25 to 35% Al, 2 to 20 % Nb, 0.5 to 10% W and/or Ta, and 0.01 to 0.5% B, the titanium aluminide alloy having a nearly fully lamellar microstructure with boride particles which are not uniformly distributed in the microstructure.

24. The titanium aluminide alloy of claim 23, which is free of Cr and Mn.

25. The titanium aluminide alloy of claim 23, having a room temperature yield strength of more than 80 ksi (560 MPa) and a room temperature elongation of at least 1%.

* * * * *

UNITED STATES PATENT AND TRADEMARK OFFICE

CERTIFICATE OF CORRECTION

PATENT NO. : 6,425,964 B1 
DATED : July 30, 2002
INVENTOR(S) : Seetharama C. Deevi et al.

It is certified that error appears in the above-identified patent and that said Letters Patent is hereby corrected as shown below:

Drawings,
In the Figures, Figure 19 is missing the y-axis label. The y-axis should read -- Minimum Creep Rate (1/s) --.

Column 2,
Line 23, "$\mu$106·cm" should read -- $\mu\Omega$·cm --.

Column 12,
Line 36, "16. The titanium aluminide alloy of Claim 1, free of Cr, V, Mn, Co, Cu and Ni." should read -- 16. The titanium aluminide alloy of Claim 1, which is free of V, Co, Cu and Ni. --.

Signed and Sealed this

Seventeenth Day of December, 2002

JAMES E. ROGAN
*Director of the United States Patent and Trademark Office*